US009212409B2

(12) United States Patent
Tofail et al.

(10) Patent No.: US 9,212,409 B2
(45) Date of Patent: Dec. 15, 2015

(54) MIXTURE OF POWDERS FOR PREPARING A SINTERED NICKEL-TITANIUM-RARE EARTH METAL (NI-TI-RE) ALLOY

(71) Applicants: University of Limerick, Limerick (IE); Medical Engineering and Development Institute, Inc., West Lafayette, IN (US)

(72) Inventors: Syed A. M. Tofail, Limerick (IE); James Butler, Aherlow (IE); James M. Carlson, Lafayette, IN (US); Garry Warren, Bruff (IE); Abbasi A. Gandhi, Ahmedabad (IN); Peter Tiernan, Caherconlish (IE)

(73) Assignees: Cook Medical Technologies LLC, Bloomington, IN (US); University of Limerick, Limerick (IE)

( * ) Notice: Subject to any disclaimer, the term of this patent is extended or adjusted under 35 U.S.C. 154(b) by 340 days.

(21) Appl. No.: 13/744,950

(22) Filed: Jan. 18, 2013

(65) Prior Publication Data

US 2013/0183188 A1 Jul. 18, 2013

Related U.S. Application Data

(60) Provisional application No. 61/587,919, filed on Jan. 18, 2012.

(51) Int. Cl.
*C22C 19/03* (2006.01)
*C22C 1/04* (2006.01)
(Continued)

(52) U.S. Cl.
CPC . *C22C 30/00* (2013.01); *B22F 3/10* (2013.01); *B22F 3/12* (2013.01); *B22F 3/14* (2013.01); *B22F 3/24* (2013.01); *C22C 1/04* (2013.01); *C22C 1/045* (2013.01); *C22C 19/03* (2013.01); *B22F 2301/155* (2013.01)

(58) Field of Classification Search
CPC ..... B22F 2301/155; B22F 3/12; B22F 3/14; B22F 3/24; C22C 19/03; C22C 1/0441; C22C 30/00
USPC ..... 419/28, 46, 48, 52; 148/556, 563, 426; 75/228, 255; 420/455
See application file for complete search history.

(56) References Cited

U.S. PATENT DOCUMENTS 5,069,226 A 12/1991 Yamauchi et al.
5,230,348 A 7/1993 Ishibe et al.
(Continued)

FOREIGN PATENT DOCUMENTS

CN 101314826 12/2008
DE 10 2007 047 522 A1 4/2009 ..... B22F 3/22
(Continued)

OTHER PUBLICATIONS

Chen J.T. et al., "An Apparatus to Measure the Shape Memory Properties of Nitinol Tubes for Medical Applications," *Journal De Physique IV*, Coll C8, 5, (1995) pp. 1247-1252.
(Continued)

*Primary Examiner* — Helene Klemanski
(74) *Attorney, Agent, or Firm* — Brinks Gilson & Lione

(57) ABSTRACT

A mixture of powders for preparing a sintered nickel-titanium-rare earth (Ni—Ti—RE) alloy includes Ni—Ti alloy powders comprising from about 55 wt. % Ni to about 61 wt. % Ni and from about 39 wt. % Ti to about 45 wt. % Ti, and RE alloy powders comprising a RE element.

26 Claims, 12 Drawing Sheets

(51) Int. Cl.

| | |
|---|---|
| ***C22C 30/00*** | (2006.01) |
| ***B22F 3/12*** | (2006.01) |
| ***B22F 3/14*** | (2006.01) |
| ***B22F 3/24*** | (2006.01) |
| ***B22F 3/10*** | (2006.01) |

(56) References Cited

U.S. PATENT DOCUMENTS

| | | | | |
|---|---|---|---|---|
| 5,636,641 | A | 6/1997 | Fariabi | |
| 5,637,089 | A | 6/1997 | Abrams et al. | |
| 5,641,364 | A | 6/1997 | Golberg et al. | |
| 5,885,381 | A | 3/1999 | Mitose et al. | |
| 5,927,345 | A | 7/1999 | Samson | |
| 5,951,793 | A | 9/1999 | Mitose et al. | |
| 5,964,968 | A | 10/1999 | Kaneko | |
| 6,165,292 | A | 12/2000 | Abrams et al. | |
| 6,277,084 | B1 | 8/2001 | Abele et al. | |
| 6,312,454 | B1 | 11/2001 | Stöckel et al. | |
| 6,312,455 | B2 | 11/2001 | Duerig et al. | |
| 6,325,824 | B2 | 12/2001 | Limon | |
| 6,352,515 | B1 | 3/2002 | Anderson et al. | |
| 6,375,458 | B1 | 4/2002 | Moorleghem et al. | |
| 6,379,380 | B1 | 4/2002 | Satz | 623/1.15 |
| 6,399,886 | B1 | 6/2002 | Avellanet | |
| 6,461,453 | B1 | 10/2002 | Abrams et al. | |
| 6,482,166 | B1 | 11/2002 | Fariabi | |
| 6,497,709 | B1 | 12/2002 | Heath | |
| 6,557,993 | B2 | 5/2003 | Rossin | |
| 6,569,194 | B1 | 5/2003 | Pelton | |
| 6,572,646 | B1 | 6/2003 | Boylan et al. | |
| 6,602,228 | B2 | 8/2003 | Nanis et al. | |
| 6,626,937 | B1 | 9/2003 | Cox | |
| 6,682,608 | B2 | 1/2004 | Abrams | |
| 6,706,053 | B1 | 3/2004 | Boylan et al. | |
| 6,776,795 | B2 | 8/2004 | Pelton | |
| 6,827,734 | B2 | 12/2004 | Fariabi | |
| 6,830,638 | B2 | 12/2004 | Boylan et al. | |
| 6,855,161 | B2 | 2/2005 | Boylan et al. | |
| 6,884,234 | B2 | 4/2005 | Aita et al. | |
| 7,128,757 | B2 | 10/2006 | Boylan et al. | |
| 7,192,496 | B2 | 3/2007 | Wojcik | |
| 7,244,319 | B2 | 7/2007 | Abrams et al. | |
| 7,258,753 | B2 | 8/2007 | Abrams et al. | |
| 7,462,192 | B2 | 12/2008 | Norton et al. | |
| 7,641,983 | B2 | 1/2010 | Stinson | |
| 8,440,031 | B2 * | 5/2013 | Syed et al. | 148/563 |
| 2001/0047185 | A1 | 11/2001 | Satz | 606/198 |
| 2002/0082681 | A1 | 6/2002 | Boylan et al. | |
| 2003/0120181 | A1 | 6/2003 | Toma et al. | |
| 2004/0143317 | A1 | 7/2004 | Stinson et al. | |
| 2004/0220608 | A1 | 11/2004 | D'Aquanni et al. | |
| 2004/0236409 | A1 | 11/2004 | Pelton et al. | |
| 2004/0249447 | A1 | 12/2004 | Boylan et al. | |
| 2005/0038500 | A1 | 2/2005 | Boylan et al. | |
| 2005/0131522 | A1 | 6/2005 | Stinson et al. | |
| 2005/0209683 | A1 | 9/2005 | Yamauchi et al. | |
| 2006/0129166 | A1 | 6/2006 | Lavelle | |
| 2006/0222844 | A1 | 10/2006 | Stinson | |
| 2007/0183921 | A1 | 8/2007 | Furuya et al. | |
| 2007/0249965 | A1 | 10/2007 | Abrams et al. | |
| 2008/0053577 | A1 | 3/2008 | Syed et al. | 148/556 |
| 2008/0114449 | A1 | 5/2008 | Gregorich et al. | |
| 2010/0310407 | A1 | 12/2010 | Koehl et al. | 419/33 |
| 2011/0114230 | A1 | 5/2011 | Syed et al. | 148/563 |
| 2013/0101455 | A1 * | 4/2013 | Tofail et al. | 419/28 |

FOREIGN PATENT DOCUMENTS

| | | | | |
|---|---|---|---|---|
| EP | 0873734 | A2 | 10/1998 | |
| JP | 48 066521 | A | 9/1973 | |
| JP | 58 157935 | A | 9/1983 | |
| JP | 59 104459 | A2 | 6/1984 | |
| JP | 60-262929 | | 12/1985 | C22C 1/04 |
| JP | 61 210142 | A2 | 9/1986 | |
| JP | 62 007839 | A2 | 1/1987 | |
| JP | 9-137241 | | 5/1997 | |
| JP | 9-263913 | | 10/1997 | C22C 45/02 |
| WO | WO 01/72349 | A1 | 10/2001 | |
| WO | WO 02/051462 | A2 | 7/2002 | |
| WO | WO 03/088805 | A2 | 10/2003 | |
| WO | WO 2004/033016 | A1 | 4/2004 | |
| WO | WO 2006/081011 | A2 | 8/2006 | |
| WO | WO 2009/070784 | A1 | 6/2009 | |
| WO | WO 2013/057292 | A1 | 4/2013 | C22C 14/00 |

OTHER PUBLICATIONS

Jingqi, L. et al., "The Isothermal Section of the Phase Diagram of the La-Ni-Ti Ternary System at 673 K," *Journal of Alloys and Compounds*, 312 (2000) pp. 121-123.

Jingqi, L. et al., "Isothermal Section of the Phase Diagram of the Ternary System Dy-Ni-Ti at 773 K," *Journal of Alloys and Compounds*, 313 (2000) pp. 93-94.

Jingqi, L. et al., "The 773 K Isothermal Section of the Ternary Phase Diagram of the Nd-Ni-Ti," *Journal of Alloys and Compounds*, 368 (2004) pp. 180-181.

Otsuka, K. et al., "Physical Metallurgy of Ti-Ni-Based Shape Memory Alloys," *Progress in Materials Science*, 50 (2005) pp. 511-678.

Patoor, E. et al., "Shape Memory Alloys, Part I: General Properties and Modeling of Single Crystals," *Mechanics of Materials*, 38 (2006) pp. 391-429.

Strnadel, B. et al., "Effect of Mechanical Cycling on the Pseudoelasticity Characteristics of Ti-Ni and Ti-Ni-Cu Alloys," *Materials Science and Engineering*, A203 (1995) pp. 187-196.

Suzuki, Y. et al., "Effects of Boron Addition on Microstructure and Mechanical Properties of Ti-Td-Ni High Temperature Shape Memory Alloys," *Materials Letters*,36 (1998) pp. 85-94.

Tian, Q. et al., "Superelasticity of TiPdNi Alloys with and without Rare Earth Ce Addition," *J. Mater. Sci. Technol.*, 19, 2 (2003) pp. 179-182.

Xu, Y. et al., "Recovery and Recrystallization Processes in Ti-Pd-Ni High Temperature Shape Memory Alloys," *Acta. Mater*. 45, 4 (1997) pp. 1503-1511.

Zhong, X. et al., "The 573 K and 773 K Isothermal Sections of the Phase Diagram of the Pr-Ni-Ti Ternary System," *Journal of Alloys and Compounds*, 316 (2001) pp. 172-174.

International Search Report and the Written Opinion for International Patent Application No. PCT/US2007/019445 dated Dec. 14, 2007.

International Preliminary Report on Patentability for International Patent Application No. PCT/US2007/019445 dated Dec. 4, 2008.

International Search Report and the Written Opinion for International Patent Application No. PCT/US2010/056687 dated Jan. 19, 2011.

Aichinger, H.; Dierker, J.; Joite-Barfuβ, S.; Säbel, M. "Raw X-Ray Data for Unfiltered Photons," *Radiation Exposure and Image Quality in X-Ray Diagnostic Radiology: Physical Principles and Clinical Applications*, Springer, Berlin.

"Biological Evaluation of Medical Devices—Part 1: Evaluation and Testing," *American National Standard ANSI/AAMI/ISO* 10993-1:2003, Association for the Advancement of Medical Instrumentation (AAMI), Arlington, VA, USA, 2003, 25 pages.

Boriskina, N.G.; Kenina, E.M. "Phase Equilibria in the Ti-TiPd-TiNi System Alloys," *Titanium '80, Science and Technology, Proceedings of the 4th International Conference on Titanium*, Kumura, H. and Izumi O., eds., 1980, The Metallurgical Society of AIME, Warrendale, PA, pp. 2917-2927.

Bozzolo, G.; Noebe, R.D.; Mosca, H.O. "Atomistic Modeling of Pd Site Preference in NiTi," *Journal of Alloys and Compounds*, 2005, 386, pp. 125-138.

Cai, W.; Tanaka, S.; Otsuka, K. "Thermal Cyclic Characteristics Under Load in a $Ti_{50.6}Pd_{30}Ti_{19.4}$ Alloy," *Materials Science Forum*, 2000, 327-328, pp. 279-282.

Cai, W.; Zhao, L. "The Reverse Transformation of Deformation-Induced Martensite in a Ni-Ti-Nb Shape Memory Alloy with Wide Hysteresis," *Shape Memory Materials'94 Proceedings of the International Symposium on Shape Memory Materials*, 1994, International Academic Publishers, pp. 235-238 (5 pages).

(56) References Cited

OTHER PUBLICATIONS

Craig, C.; Friend, C.; Edwards, M.; Gokcen, N. "Tailoring Radiopacity of Austenitic Stainless Steel for Coronary Stents," *Proceedings from the Materials & Processes for Medical Devices Conference*, Sep. 8-10, 2003, ASM International, Anaheim, CA, 2004, pp. 294-297.

Di, J.; Wenxi, L.; Ming, H.; Defa, W.; Zhizhong, D. "Some Properties of Ni-Ti-Nb-X Quarternary Alloys," *Z. Metallkd.*, 2000, 91(3), pp. 258-260.

Donkersloot, H.C.; Van Vucht, J.H.N. "Martensitic Transformations in Gold-Titanium, Palladium-Titanium and Platinum-Titanium Alloys Near the Equiatomic Composition," *Journal of the Less-Common Metals*, 1970, 20, pp. 83-91.

Eckelmeyer, K.H. "The Effect of Alloying on the Shape Memory Phenomenon in Nitinol," *Scripta Metallurgica*, 1976, 10, pp. 667-672.

Enami, K.; Nara, M.; Maeda, H. "Effect of W Addition on the Martensitic Transformation and Shape Memory Behaviour of the TiNi-Base Alloys," *Journal de Physique IV*, 1995, 5, pp. C8-629-C8-633.

Enami, K.; Yoshida, T.; Nenno, S. "Premartensitic and Martensitic Transformations in TiPd-Fe Alloys," *Proceedings of the International Conference on Martensitic Transformations*, The Japan Institute of Metals, 1986, pp. 103-108.

Golberg, D.; Xu, Y.; Murakami, Y.; Otsuka, K.; Ueki, T.; Horikawa, H. "High-Temperature Shape Memory Effect in $Ti_{50}Pd_{50-x}Ni_x$ (x=10, 15, 20) Alloys," *Materials Letters*, 1995, 22, pp. 241-248.

Gschneidner Jr., K.; Russell, A.; Pecharsky, A.; Morris, J.; Zhang, Z.; Lograsso, T.; Hsu, D.; Chester Lo, C.H.; Ye, Y.; Slager, A.; Kesse, D. "A Family of Ductile Intermetallic Compounds," *Nature Materials*, 2003, 2, pp. 587-590.

Gupta, K.P. "The Hf-Ni-Ti (Hafnium-Nickel-Titanium) System," *Journal of Phase Equilibria*, 2001, 22(1), pp. 69-72.

Hashi, K.; Ishikawa, K.; Matsuda, T.; Aoki, K. "Hydrogen Permeation Characteristics of Multi-Phase Ni-Ti-Nb Alloys," *Journal of Alloys and Compounds*, 2004, 368, pp. 215-220.

Hashi, K.; Ishikawa, K.; Matsuda, T.; Aoki, K. "Hydrogen Permeation of Ternary Ni-Ti-Nb Alloys," *Advanced Materials for Energy Conversion II*, 2004, TMS (The Minerals, Metals & Materials Society), Warrendale, PA, pp. 283-289.

Haxel, G.B.; Hedrick, J.B.; Orris, G.J. "Rare Earth Elements-Critical Resources for High Technology," USGS Fact Sheet 087-02, U.S. Dept. of the Interior, 2002, 4 pages.

Hodgson, D.E.; Brown, J.W. *Using Nitinol Alloys*, Shape Memory Applications, Inc., San Jose, CA, 2000, 52 pages.

Hosoda, H.; Tsuji, M.; Takahashi, Y.; Inamura, T.; Wakashima, K.; Yamabe-Mitarai, Y.; Miyazaki, S.; Inoue, K. "Phase Stability and Mechanical Properties of Ti-Ni Shape Memory Alloys containing Platinum Group Metals," *Materials Science Forum*, 2003, 426-432, pp. 2333-2338.

Huang, X.; Lei Y.; Huang, B.; Chen, S.; Hsu, T.Y. "Effect of Rare-Earth Addition on the Shape Memory Behavior of a FeMnSiCr Alloy," *Materials Letters*, 2003, 57, pp. 2787-2791.

Huisman-Kleinherenbrink, P.M.; Beyer, J. "The Influence of Ternary Additions on the Transformation Temperatures of NiTi Shape Memory Alloys—A Theoretical Approach," *Journal de Physique IV*, 1991, 1, pp. C4-47-C4-52.

Jung, J.; Ghosh, G.; Olson, G.B. "A Comparative Study of Precipitation Behavior of Heusler Phase ($Ni_2TiAl$) from B2-TiNi in Ni-Ti-Al and Ni-Ti-Al-X (X = Hf, Pd, Pt, Zr) Alloys," *Acta Materialia*, 2003, 51, pp. 6341-6357.

Kattner, U.R. "Thermodynamic Modeling of Multicomponent Phase Equilibria," Journal of Metals (*JOM*), 1997, 49(12), pp. 14-19.

Khachin, V.N.; Gjunter, V.E.; Sivokha, V.P.; Savvinov, A.S. "Lattice Instability, Martensitic Transformations, Plasticity and Anelasticity of TiNi," *Proc. ICOMAT*, 1979, 79, pp. 474-479.

Khachin, V.N.; Matveeva, N.M.; Sivokha, V.P.; Chernov, D.B.; Kovneristyi, Y.K. "High-Temperature Shape-Memory Effects in Alloys of the TiNi-TiPd System," Translated from Doklady Akademii Nauk SSSR, vol. 257, No. 1, pp. 167-169, Mar. 1981. Plenum Publishing Corporation, New York, NY, 1981, pp. 195-197.

Lindquist, P.G.; Wayman, C.M. "Shape Memory and Transformation Behavior of Martensitic Ti-Pd-Ni and Ti-Pt-Ni Alloys," *Engineering Aspects of Shape Memory Alloys*, Butterworth-Heinemann, Ltd., London, UK, 1990, pp. 58-68.

Lindquist, P.G. "Structure and Transformation Behavior of Martensitic Ti—(Ni, Pd) and Ti—(Ni, Pt) Alloys," University Microfilms International, Ann Arbor, MI, 1988, Order No. 8908756, 134 pages.

Liu, A.L.; Gao, Z.Y.; Gao, L.; Cai, W.; Wu, Y. "Effect of Dy Addition on the Microstructure and Martensitic Transformation of a Ni-rich TiNi Shape Memory Alloy," *Journal of Alloys and Compounds*, 2007, 437, pp. 339-343.

Liu, A.; Meng, X.; Cai, W.; Zhao, L. "Effect of Ce Addition on Martensitic Transformation Behavior of TiNi Shape Memory Alloys," *Materials Science Forum*, 2005, 475-479, pp. 1973-1976, 6 pages.

Liu, J.; Ma, J.; Wang, Z.; Wu, G. "Effects of Aging Treatment on Shape Memory Characteristics of Ni-Ti-Ta Alloy," *Rare Metal Materials and Engineering*, 2003, 32(10), pp. 777-781 (6 pages).

Liu, J.; Pan, S.; Zhuang, Y. "Isothermal Section of the Phase Diagram of the Ternary System Dy-Ni-Ti at 773 K," *Journal of Alloys and Compounds*, 2000, 313, pp. 93-94.

Liu, M.; Tu, M.J.; Zhang, X.M.; Li, Y.Y.; Shelyakov, A.V. "Microstructure of Melt-Spinning High Temperature Shape Memory Ni-Ti-Hf Alloys," *Journal of Materials Science Letters*, 2001, 20, pp. 827-830.

Ma, J.; Liu, J.; Wang, Z.; Xue, F.; Wu, K-H.; Pu, Z. "Effects of Ta Addition on NiTi Shape Memory Alloys," *J. Mater. Sci. Technol.*, 2000, 16(5), pp. 534-536.

Ma, J.; Yang, F.; Subirana, J.I.; Pu, Z.J.; Wu; K.H. "Study of NiTi-Ta Shape Memory Alloys," *SPIE Conference on Smart Materials Technologies*, 1998, 3324, pp. 50-57.

Meisner, L.L.; Sivokha, V.P. "The Effect of Applied Stress on the Shape Memory Behavior of TiNi-Based Alloys with Different Consequences of Martensitic Transformations," *Physica B*, 2004, 344, pp. 93-98.

Noebe, R.; Biles, T.; Padula, S.A. "NiTi-Based High-Temperature Shape-Memory Alloys: Properties, Prospects, and Potential Applications," *Materials Engineering*, 2006, 32, pp. 145-186, Marcel Dekker, Inc., New York, USA, 75 pages.

Noebe, R.; Gaydosh, D.; Padula, S.; Garg, A.; Biles, T.; Nathal, M. "Properties and Potential of Two (Ni,Pt)Ti Alloys for Use as High-Temperature Actuator Materials," *12th SPIE Conf. International Symposium*, San Diego, CA, USA, Mar. 6-10, 2005, pp. 1-12.

Otsuka, K.; Oda, K.; Ueno, Y.; Piao, M.; Ueki, T.; Horikawa, H. "The Shape Memory Effect in a $Ti_{50}Pd_{50}$ Alloy," *Scripta Metallurgica et Materialia*, 1993, 29, pp. 1355-1358.

Oyamada, O.; Amano, K.; Enomoto, K., Shigenaka, N.; Matsumoto, J.; Asada, Y. "Effect of Environment on Static Tensile and Fatigue Properties of Ni-Ti-Nb Shape Memory Alloy," *JSME International Journal*, 1999, Series A, 42, pp. 243-248.

Pryakhina, L.I.; Myasnikova, K.P.; Burnashova, V.V.; Cherkashin, E.E.; Markiv, V.Y. "Ternary Intermetallic Compounds in the System Ni-Ti-Nb," A. A. Baikov Institute of Metallurgy; (Translated from *Poroshkovaya Metallurgiya*, 1966, 8(44), pp. 61-69) pp. 643-650.

Qiang, D.S.; Ying, Q.G.; Bo, Y.H.; Ming, T.S. "Phase Transformation and Memory Effect of the High Temperature Shape Memory Alloy $Ti_{49}Ni_{25}Pd_{26}B_{0.12}$," *Shape Memory Materials '94 Proceedings of the International Symposium on Shape Memory Materials*, 1994, International Academic Publishers, Beijing, China, pp. 248-252 (6 pages).

"Radiopaque Polymers," *Encyclopedia of Polymer Science and Engineering*, John Wiley & Sons, Inc., New York, USA, 1988, 14, pp. 1-8 (10 pages).

Rios, O.; Noebe, R.; Biles, T.; Garg, A.; Palczer, A.; Scheiman, D.; Seifert, H.J.; Kaufman, M. "Characterization of Ternary NiTiPt High-Temperature Shape Memory Alloys," *12th SPIE Conf. International Symposium*, San Diego, CA, USA, Mar. 6-10, 2005, pp. 1-12.

(56) References Cited

OTHER PUBLICATIONS

Russell, S.M.; Hodgson, D.E.; Basin, F. "Improved NiTi Alloys for Medical Applications," *SMST-97: Proceedings of the Second International Conference on Shape Memory and Superelastic Technologies*, Pacific Grove, CA, 1997, pp. 429-436.
Seo, C-Y.; Choi, S-J.; Choi, J.; Park, C-N.; Lee, P.S.; Lee, J-Y. "Effect of Ti and Zr Additions on the Characteristics of $AB_5$-type Hydride Electrode for Ni-MH Secondary Battery," *International Journal of Hydrogen Energy*, 2003, 28, 317-327.
Shimizu, S.; Xu, Y.; Okunishi, E.; Tanaka, S.; Otsuka, K.; Mitose, K. "Improvement of Shape Memory Characteristics by Precipitation-Hardening of Ti-Pd-Ni Alloys," *Materials Letters*, 1998, 34, pp. 23-29.
"Standard Practice for Selecting Generic Biological Test Methods for Materials and Devices," *American Society for Testing and Materials (ASTM) Standard* F748-04, ASTM International, West Conshohocken, PA, 2004, 1 page.
"Standard Practice for Direct Contact Cell Culture Evaluation of Materials for Medical Devices," *American Society for Testing and Materials (ASTM) Standard* F813-01, ASTM International, West Conshohocken, PA, 2001, 4 pages.
"Standard Specification for Wrought Nickel-Titanium Shape Memory Alloys for Medical Devices and Surgical Implants," *American Society for Testing and Materials (ASTM) Standard* F2063-05, ASTM International, West Conshohocken, PA, 2005, 4 pages.
"Standard Test Method for Agar Diffusion Cell Culture Screening for Cytotoxicity," *American Society for Testing and Materials (ASTM) Standard* F895-84, ASTM International, West Conshohocken, PA, 2006, 5 pages.
"Standard Test Method for Tension Testing of Nickel-Titanium Superelastic Materials," *American Society for Testing and Materials (ASTM) Standard* F2516-07, ASTM International, West Conshohocken, PA, 2007, 6 pages.
"Standard Test Method for Transformation Temperature of Nickel-Titanium Alloys by Thermal Analysis," *American Society for Testing and Materials (ASTM) Standard* F2004-05, ASTM International, West Conshohocken, PA, 2005, 4 pages.
Sun, L.; Wu, K-H. "The Two-Way Memory Effect (TWME) in NiTi-Pd High Temperature Shape Memory Alloys," *SPIE Conference Proceedings: Smart Structures and Materials*, 1994, 2189, pp. 298-305.
Suzuki, Y.; Xu, Y.; Morito, S.; Otsuka, K.; Mitose, K. "Effects of Boron Addition on Microstructure and Mechanical Properties of Ti-Pd-Ni High-Temperature Shape Memory Alloys," *Materials Letters*, 1998, 36, pp. 85-94.
Thoma, P.E.; Boehm, J.J. "The Effect of Hafnium and Thermal Cycling on the Transformation Temperatures of NiTi-Based Shape Memory Alloys," *Mat. Res. Soc. Symp. Proc.*, 2000, 604, pp. 221-226.
*Using Nitinol Alloys*, Johnson Matthey, San Jose, CA, 2004, 1-46.
Wong, T.; Seuntjens, J.M.; "Development of Rare Earth Regenerator Materials in Fine Wire Form," *Adv. Cryog. Eng.*, 1997, 42, pp, 439-444, 2 page Abstract.
Wu, K.H.; Liu, Y.Q.; Maich, M.; Tseng, H.K. "The Mechanical Properties of a NiTi-Pd High Temperature Shape Memory Alloy," *SPIE Conference Proceedings: Smart Structures and Materials*, 1994, 2189, pp. 306-313.
Wu, S.K.; Wayman, C.M. "Martensitic Transformations and the Shape Memory Effect in $Ti_{50}Ni_{10}Au_{40}$ and $Ti_{50}Au_{50}$ Alloys," *Metallography*, 1987, 20, pp. 359-376.
Xu, Y.; Otsuka, K.; Furubayashi, E.; Mitose, K. "TEM Observation of Recrystallization Process in Solution-Treated $Ti_{50}Pd_{50}$ Martensite," *Materials Letters*, 1998, 34, pp. 14-18.
Xu, Y.; Shimizu, S.; Suzuki, Y.; Otsuka, K.; Ueki, T.; Mitose, K. "Recovery and Recrystallization Processes in Ti-Pd-Ni High-Temperature Shape Memory Alloys," *Acta Mater.*, 1997, 45(4), pp. 1503-1511.
Yang, W.S.; Mikkola, D.E. "Ductilization of Ti-Ni-Pd Shape Memory Alloys with Boron Additions," *Scripta Metallurgica et Materialia*, 1993, 28, pp. 161-165.
Zadno, G.R.; Duerig, T.W. "Linear Superelasticity in Cold-Worked Ni-Ti," *Engineering Aspects of Shame Memory Alloys*, Butterworth-Heinemann, Ltd., 1990, pp. 414-419.
Zhang, C.; Thoma, P.; Chin, B.; Zee, R. "Martensitic and R-Phase Transformations in Ni-Ti and Ni-Ti-Hf," *Trans. Nonferrous Met. Soc.* China, 1999, 9(1), pp. 55-64.
Zhao, C. "Improvement of Shape Memory Effect in Fe-Mn-Si-Cr-Ni Alloys," *Metallurgical and Materials Transactions A*, 1999, 30A, pp. 2599-2604.
Zhu, Y.R.; Pu, Z.J.; Li, C.; Wu, K.H. "The Stability of NiTi-Pd and NiTi-Hf High Temperature Shape Memory Alloys," *Shape Memory Materials'94 Proceedings of the International Symposium on Shape Memory Materials*, 1994, International Academic Publishers, pp. 253-257 (6 pages).
International Search Report and Written Opinion for International PCT Application No. PCT/US2013/022088, mailing date May 24, 2013, pp. 1-15.
Bertheville, B. et al., "Alternative Powder Metallurgical Processing of Ti-rich NiTi Shape-Memory Alloys," *Scripta Materialia*, 52 (2005) pp. 507-512.
Bram, M. et al., "Powder Metallurgical Fabrication Processes for NiTi Shape Memory Alloy Parts," *Materials Science and Engineering*, A337 (2002) pp. 254-263.
Frenzel, J. et al., "High Quality Vacuum Induction Melting of Small Quantities of NiTi Shape Memory Alloys in Graphite Crucibles," *Journal of Alloys and Compounds*, 385 (2004) pp. 214-223.
Fu, Y.Q. et al., "Spark Plasma Sintering of TiNi Nano-Powders for Biological Application," *Nanotechnology*, 17 (2006) pp. 5293-5298.
Köhl, Manuel et al., "Powder Metallurgical Near-Net-Shape Fabrication of Porous NiTi Shape Memory Alloys for Use as Long-Term Implants by the Combination of the Metal Injection Molding Process with the Space-Holder Technique," *Advanced Engineering Materials*, 11, 12 (2009) pp. 959-968.
Krone, L. et al., "Mechanical Behavior of NiTi Parts Prepared by Powder Metallurgical Methods," *Materials Science and Engineering* A 378 (2004) pp. 185-190.
McNeese, Matthew D. et al., "Processing of TiNi from Elemental Powders by Hot Isostatic Pressing," *Materials Science and Engineering*, A280 (2000) pp. 334-348.
Matsumoto, Akihiro et al., "Fabrication of Ti-Zr-Ni Bulk Quasicrystal by Mechanical Alloying and Pulse Current Sintering," *Journal of Alloys and Compounds*, 434-435 (2007) pp. 315-318.
Mentz, Juliane et al., "Powder Metallurgical Processing of NiTi Shape Memory Alloys with Elevated Transformation Temperatures," *Materials Science and Engineering*, A491 (2008) pp. 270-278.
Mentz, J. et al., "Improvement of Mechanical Properties of Powder Metallurgical NiTi by Reduction of Impurity Phases," *Proceedings of the International Conference on Shape Memory and Superlastic Technologies*, (2008) pp. 399-407.
Neves, F. et al., "Mechanically Activated Reactive Forging Synthesis (MARFOS) of NiTi," *Intermetallics*, 16 (2008) pp. 889-895.
Neves, F. et al., "Reactive Extrusion Synthesis of Mechanically Activated Ti-50Ni Powders," *Intermetallics*, 15 (2007) pp. 1623-1631.
Omori, Mamoru, "Sintering, Consolidation, Reaction and Crystal Growth by the Spark Plasma System (SPS)," *Materials Science and Engineering*, A287 (2000) pp. 183-188.
Pozdnyakova, A. et al., "Analysis of Porosity in NiTi SMA's Changed by Secondary Pulse Electric Current Treatment by Means of Ultra Small Angle Scattering and Micro-Computed Tomography," *Intermetallics*, 18 (2010) pp. 907-912.
Sadrnezhaad, S.K. et al., "Effect of Mechanical Alloying and Sintering on Ni-Ti Powders,"*Materials and Manufacturing Processes*, 19,3 (2004) pp. 475-486.
Schüller, E. et al., "Phase Transformation Temperatures for NiTi Alloys Prepared by Powder Metallurgical Processes," *Materials Science and Engineering* A 378 (2004) pp. 165-169.
Shearwood, C. et al., "Spark Plasma Sintering of TiNi Nano-Powder," *Scripta Materialia*, 52, 6 (2005) pp. 455-460.
"μ-MIM: Making the Most of NiTi," Metal Powder Report 63, 5 (2008) pp. 21-24.
Examination Report for EP Patent Application No. 13 704 274.3 dated Aug. 13, 2015, 5 pages.
US 5,976,281, 11/1999, Nakamura et al. (withdrawn)

* cited by examiner

Processing option : All elements analysed (Normalised)

| Spectrum | In stats. | Ti | Fe | Ni | Er |
|---|---|---|---|---|---|
| Spectrum 1 | Yes | 50.50 | -0.13 | 49.48 | 0.16 |
| Spectrum 2 | Yes | 4.44 | 0.24 | 50.06 | 45.26 |
| Spectrum 3 | Yes | 51.10 | 0.14 | 46.55 | 2.21 |
| Spectrum 4 | Yes | 12.38 | 0.06 | 45.58 | 41.98 |
| Mean | | 29.60 | 0.08 | 47.92 | 22.40 |
| Std. deviation | | 24.69 | 0.16 | 2.19 | 24.55 |
| Max. | | 51.10 | 0.24 | 50.06 | 45.26 |
| Min. | | 4.44 | -0.13 | 45.58 | 0.16 |

All results in atomic%

MIXTURE OF POWDERS FOR PREPARING A SINTERED NICKEL-TITANIUM-RARE EARTH METAL (NI-TI-RE) ALLOY

RELATED APPLICATION

The present patent document claims the benefit of the filing date under 35 U.S.C. §119 to U.S. Provisional Patent Application No. 61/587,919, filed Jan. 18, 2012, and which is hereby incorporated by reference in its entirety.

TECHNICAL FIELD

The present disclosure is related generally to nickel-titanium alloys including a rare earth element, and more particularly to powder metallurgical processing of nickel-titanium alloys including a rare earth element.

BACKGROUND

Nickel-titanium alloys are commonly used for the manufacture of intraluminal biomedical devices, such as self-expandable stents, stent grafts, embolic protection filters, and stone extraction baskets. Such devices may exploit the superelastic or shape memory behavior of equiatomic or near-equiatomic nickel-titanium alloys, which are commonly referred to as Nitinol. As a result of the poor radiopacity of nickel-titanium alloys, however, such devices may be difficult to visualize from outside the body using non-invasive imaging techniques, such as x-ray fluoroscopy. Visualization is particularly problematic when the intraluminal device is made of fine wires or thin-walled struts. Consequently, a clinician may not be able to accurately place and/or manipulate a Nitinol stent or basket within a body vessel.

Current approaches to improving the radiopacity of nickel-titanium medical devices include the use of radiopaque markers, coatings, or cores made of heavy metal elements. In addition, noble metals such as platinum (Pt), palladium (Pd) and gold (Au) have been employed as alloying additions to the improve the radiopacity of Nitinol, despite the high cost of these elements. In a more recent development, it has been shown (e.g., U.S. Patent Application Publication 2008/0053577, "Nickel-Titanium Alloy Including a Rare Earth Element") that rare earth elements such as erbium can be alloyed with Nitinol to yield a ternary alloy with radiopacity that is comparable to if not better than that of a Ni—Ti—Pt alloy.

Ternary nickel-titanium alloys that include rare earth or other alloying elements are commonly formed by vacuum melting techniques. However, upon cooling the alloy from the melt, a brittle network of secondary phase(s) may form in the alloy matrix, potentially diminishing the workability and mechanical properties of the ternary alloy. If the brittle second phase network cannot be broken up by suitable homogenization heat treatments and/or thermomechanical working steps, then it may not be possible to find practical application for the ternary nickel-titanium alloy in medical devices or other applications.

BRIEF SUMMARY

It has been discovered that, by using preferred combinations of starting powders in conjunction with appropriate sintering conditions, sintered Ni—Ti—RE alloys that exhibit good workability along with a desired austenite finish ($A_f$) temperature may be produced.

A mixture of powders for preparing a sintered nickel-titanium-rare earth (Ni—Ti—RE) alloy includes Ni—Ti alloy powders comprising from about 55 wt. % Ni to about 61 wt. % Ni and from about 39 wt. % Ti to about 45 wt. % Ti, and RE alloy powders including a RE element.

A method of forming a sintered nickel-titanium-rare earth (Ni—Ti—RE) alloy comprises adding Ni—Ti alloy powders and RE alloy powders to a powder consolidation unit including an electrically conductive die and punch connectable to a power supply. The Ni—Ti alloy powders comprise from about 55 wt. % Ni to about 61 wt. % Ni and from about 39 wt. % Ti to about 45 wt. % Ti, and the RE alloy powders include a RE element. The powders are heated to a sintering temperature of from about 730° C. to about 840° C., and a pressure of from about 60 MPa to about 100 MPa is applied to the powders at the sintering temperature. A sintered Ni—Ti—RE alloy is formed.

BRIEF DESCRIPTION OF THE DRAWINGS

FIG. 1A is obtained from Hungria T. et al., (2009) "Spark Plasma Sintering as a Useful Technique to the Nanostructuration of Piezo-Ferroelectric Materials," *Advanced Engineering Materials* 11:8, p. 615-631;

DETAILED DESCRIPTION

Figure 1A:
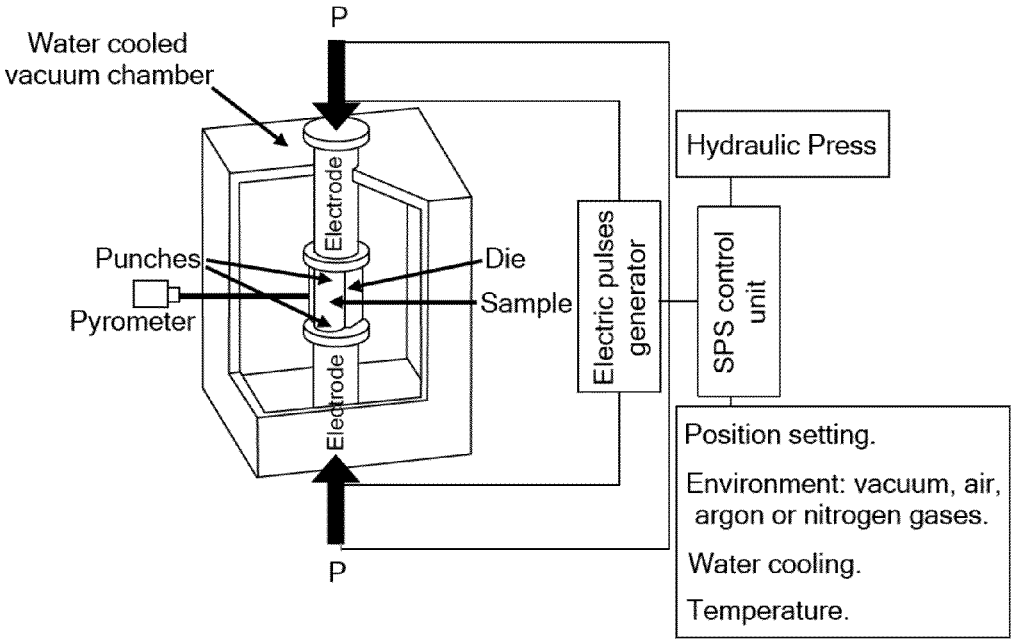
FIGS. 1A and 1B are cross-sectional schematics of a spark plasma sintering (SPS) apparatus and an SPS die, respectively, where

As used in the following specification and the appended claims, the following terms have the meanings ascribed below:

Martensite start temperature (Ms) is the temperature at which a phase transformation to martensite begins upon cooling for a shape memory material exhibiting a martensitic phase transformation.

Martensite finish temperature (Mf) is the temperature at which the phase transformation to martensite concludes upon cooling.

Austenite start temperature (As) is the temperature at which a phase transformation to austenite begins upon heating for a shape memory material exhibiting an austenitic phase transformation.

Austenite finish temperature (Af) is the temperature at which the phase transformation to austenite concludes upon heating.

Radiopacity is a measure of the capacity of a material or object to absorb incident electromagnetic radiation, such as x-ray radiation. A radiopaque material preferentially absorbs incident x-rays and tends to show high radiation contrast and good visibility in x-ray images. A material that is not radiopaque tends to transmit incident x-rays and may not be readily visible in x-ray images.

Workability refers to the ease with which an alloy may be formed to have a different shape and/or dimensions, where the forming is carried out by a method such as rolling, forging, extrusion, etc.

Cold working or cold forming is plastically deforming a component without applying heat to alter the size, shape and/or mechanical properties of the component.

Hot working or hot forming is plastically deforming a component at an elevated temperature (typically at or above the recrystallization temperature of the component) to alter the size, shape and/or mechanical properties of the component.

The term "themomechanical processing" may refer to hot and/or cold working.

Percent (%) cold work is a measurement of the amount of plastic deformation imparted to a component, where the amount is calculated as a percent reduction in a given dimension. For example, in wire drawing, the % cold work may correspond to the percent reduction in the cross-sectional area of the wire resulting from a drawing pass.

The term "prealloyed" is used to describe powders that are obtained from an ingot of a particular alloy composition that has been converted to a powder (e.g., by gas atomization). Such powders may be referred to as "prealloyed powders" or "alloy powders" in the present disclosure.

Sintering temperature refers to a temperature at which precursor powders may be sintered together when exposed to an applied pressure.

Softening temperature, when used in reference to a rare earth element, refers to a temperature at which the rare earth element softens, as determined by hot hardness measurements or melting temperature data.

The terms "comprising," "including" and "having" are used interchangeably throughout the specification and claims as open-ended transitional terms that cover the expressly recited subject matter alone or in combination with unrecited subject matter.

As noted above, novel combinations of starting powders may be used in conjunction with appropriate sintering conditions to form sintered Ni—Ti—RE alloys that exhibit good workability and ductility along with a desired $A_f$ temperature. The starting powders may be selected to overcompensate for the amount of Ni that may react with the RE element during sintering, and thus the sintered Ni—Ti—RE alloy may retain a sufficient amount of Ni in the matrix phase to exhibit an $A_f$ temperature below body temperature. The sintered Ni—Ti—RE alloy may thus be superelastic at body temperature. In some cases, the desired $A_f$ temperature may be achieved after hot and/or cold working of the sintered alloy. The inventors have recognized that the hot and cold workability of the sintered Ni—Ti—RE is influenced not only by the composition of the starting powders but also by the sintering conditions. For example, an improved result may be achieved by increasing the sintering pressure while decreasing the sintering temperature, as discussed further below.

A mixture of powders for preparing a sintered nickel-titanium-rare earth metal (Ni—Ti—RE) alloy may include Ni—Ti powders and rare earth element-containing powders. The Ni—Ti powders may be prealloyed Ni—Ti powders, which are alternately referred to as Ni—Ti alloy powders, of an appropriate composition that may be substantially equiatomic (i.e., about 50 at. % Ni (about 56 wt. % Ni) and 50 at. % Ti (about 44 wt. % Ti)) or, more preferably, nickel-rich (i.e., greater than about 50 at. % Ni (about 56 wt. % Ni). Alternatively, elemental Ni powders and elemental Ti powders may be used in the same proportions. Throughout this disclosure, powders including the elements Ni and Ti may be referred to as Ni—Ti powders whether they are elemental Ni and Ti powders or Ni—Ti alloy powders (prealloyed Ni—Ti powders).

Several different types of rare earth element-containing powders can be added to the Ni—Ti powders to form the sintered Ni—Ti—RE alloy. The term "rare earth element" is used alternately with "rare earth metal" to refer to elements found in the lanthanide series and/or the actinide series of the periodic table, which include La, Ce, Pr, Nd, Pm, Sm, Eu, Gd, Tb, Dy, Ho, Er, Tm, Yb, Lu, Ac, Th, Pa, and U. In addition, yttrium (Y) and scandium (Sc) are sometimes referred to as rare earth elements although they are not elements of the lanthanide or actinide series. Typically, the rare earth element is selected from the group consisting of La, Pr, Nd, Pm, Sm, Eu, Gd, Tb, Dy, Ho, Er, Tm, Yb, and Lu. Preferably the rare earth element includes erbium.

The powders may be elemental RE powders (including only the rare earth element and any incidental impurities) or RE alloy powders that include, in addition to the rare earth element and any incidental impurities, one or more additional alloying elements and/or dopant elements. Specific examples of these powders are provided below.

According to one embodiment, the mixture of powders for preparing a sintered Ni—Ti—RE alloy may include Ni—Ti alloy powders and RE alloy powders. The Ni—Ti alloy powders may comprise from about 55 wt. % Ni to about 61 wt. % Ni and from about 39 wt. % Ti to about 45 wt. % Ti, or from about 57 wt. % Ni to about 59 wt. % Ni and from about 41 wt. % Ti to about 43 wt. % Ti, and the RE alloy powders include a RE element and may also include at least one additional element.

The at least one additional element may be an additional alloying element or a dopant element selected from the group consisting of B, Al, Cr, Mn, Fe, Ni, Co, Cu, Zn, Ga, Ge, Zr, Nb, Mo, Tc, Ru, Rh, Pd, Ag, Cd, In, Sn, Sb, Hf, Ta, W, Re, Os, Ir, Pt, Au, Hg, TI, Pb, Bi, Po, V, other rare earth elements, and Y. The additional element may be present in the RE alloy powder at a concentration that may be as low as parts per million (ppm) levels to as high as about 95 wt. %. When used herein, ppm is in terms of weight. Typically, the additional element has a concentration of no more than about 50 wt. %, no more than about 30 wt. %, or no more than about 15 wt. %, and it may be no more than about 5 wt. % of the RE alloy powder. For example, in the case of a dopant element such as B, the concentration may be at least about 10 ppm, at least about 50 ppm, or at least about 100 ppm. Typically, the concentration of the dopant element is no more than about 1000 ppm, or no more than about 500 ppm, or no more than about 300 ppm. In the case of an additional alloying element, which may be, for example, a transition metal or another metal, the concentration may be at least about 0.1 wt. %, at least about 1 wt. %, at least about 5 wt. %, at least about 10 wt. %, or at least about 20 wt. % of the RE alloy powders.

The Ni—Ti alloy powders mixed with the RE alloy powders may comprise a mixture of first binary alloy powders and second binary alloy powders, where the first binary alloy powders comprise about 54-58 wt. % Ni and about 42-46 wt. % Ti, and the second binary alloy powders comprise about 58-62 wt. % Ni and about 38-42 wt. % Ti. For example, the first binary alloy powders may include about 56 wt. % Ni and about 44 wt. % Ti and the second binary alloy powders comprise about 60 wt. % Ni and about 40 wt. % Ti. A weight ratio of the first binary alloy powders to the second binary alloy powders may be at least about 30:70, at least about 40:60, at least about 50:50, or at least about 60:40. The weight ratio may also be no more than about 50:50, no more than about 60:40, or no more than about 70:30. For example, the weight ratio may range from about 70:30 to about 30:70, or from about 60:40 to about 40:60. Advantageously, the weight ratio is from about 40:60 to about 50:50, as discussed in the Examples.

The Ni—Ti alloy powders may not comprise a mixture of first and second binary alloy powders of different compositions, but rather may include a single binary powder composition. For example, the Ni—Ti alloy powders may comprise from about 58 wt. % Ni to about 59 wt. % Ni and from about 41 wt. % Ti to about 42 wt. % Ti, e.g., about 58.5 wt. % Ni and about 41.5 wt. % Ti.

A weight ratio of the Ni—Ti alloy powders to the RE alloy powders may be at least about 60:40, at least about 65:35, at least about 70:30, at least about 75:25, or at least about 80:20. Typically the weight ratio of the Ni—Ti alloy powders to the RE alloy powders is no more than about 90:10, or no more than about 85:15. For example, the weight ratio may be from about 75:25 to about 85:15, or about 83:17. The desired weight ratio may be determined based on the desired concentration of the rare earth element in the sintered Ni—Ti—RE alloy, while taking into account the concentration of any additional elements in the RE alloy powders. Experiments regarding the radiopacity of Ni—Ti—RE alloys have shown that an amount of from about 10 wt. % RE to about 30 wt. % RE, from about 12 wt. % RE to about 25 wt. % RE, or from about 15 wt. % RE to about 20 wt. % RE, may be advantageous for the sintered Ni—Ti—RE alloy.

Figure 1B:
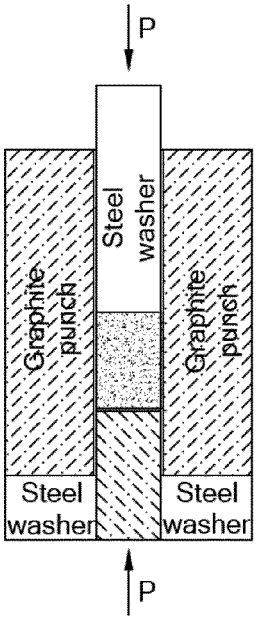
Figure 1C:
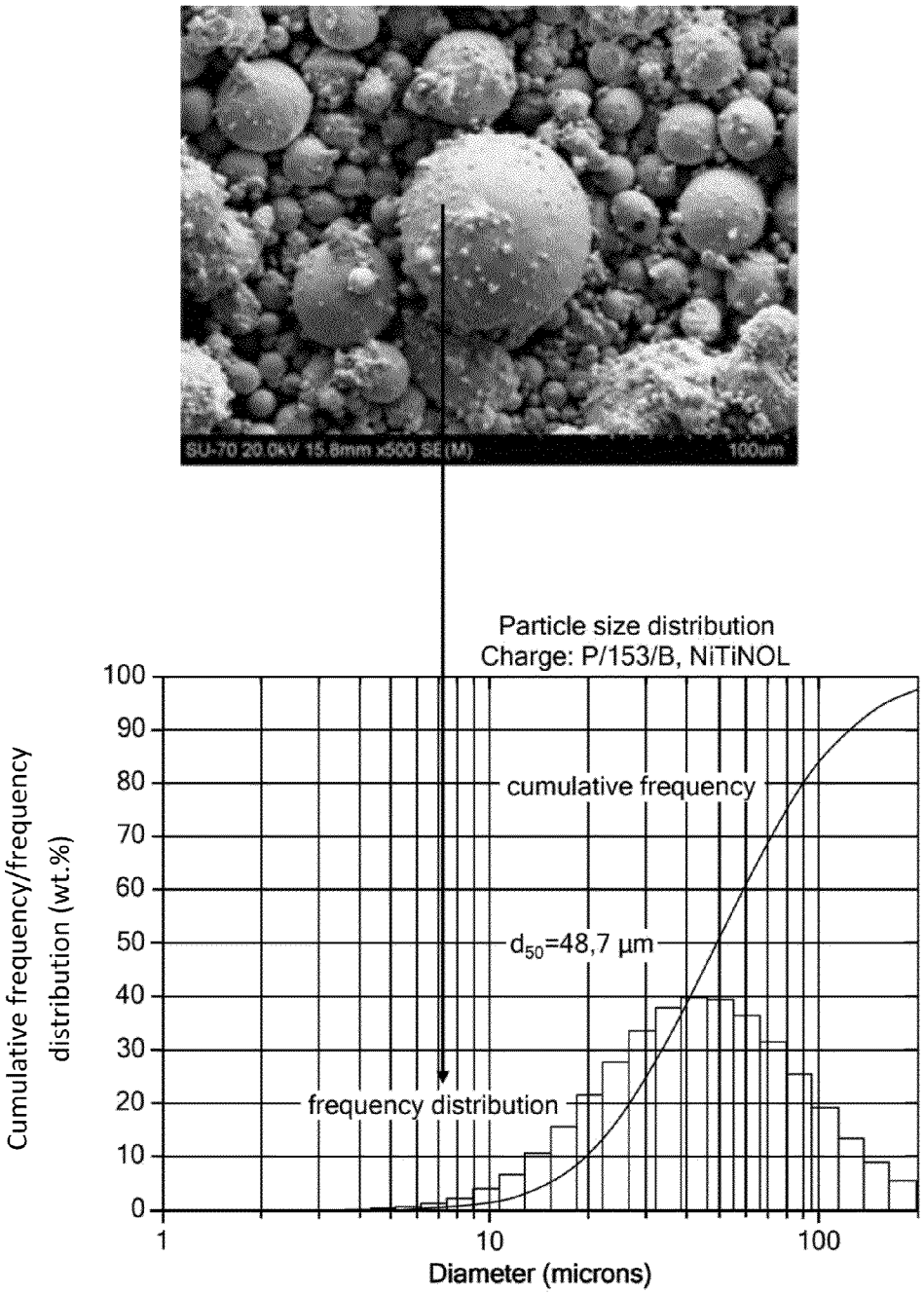
FIG. 1C is a scanning electron microscopy (SEM) image of exemplary as-received pre-alloyed gas atomized powders having a particle size distribution as shown, where d50 is the average particle size.
Figure 1D:
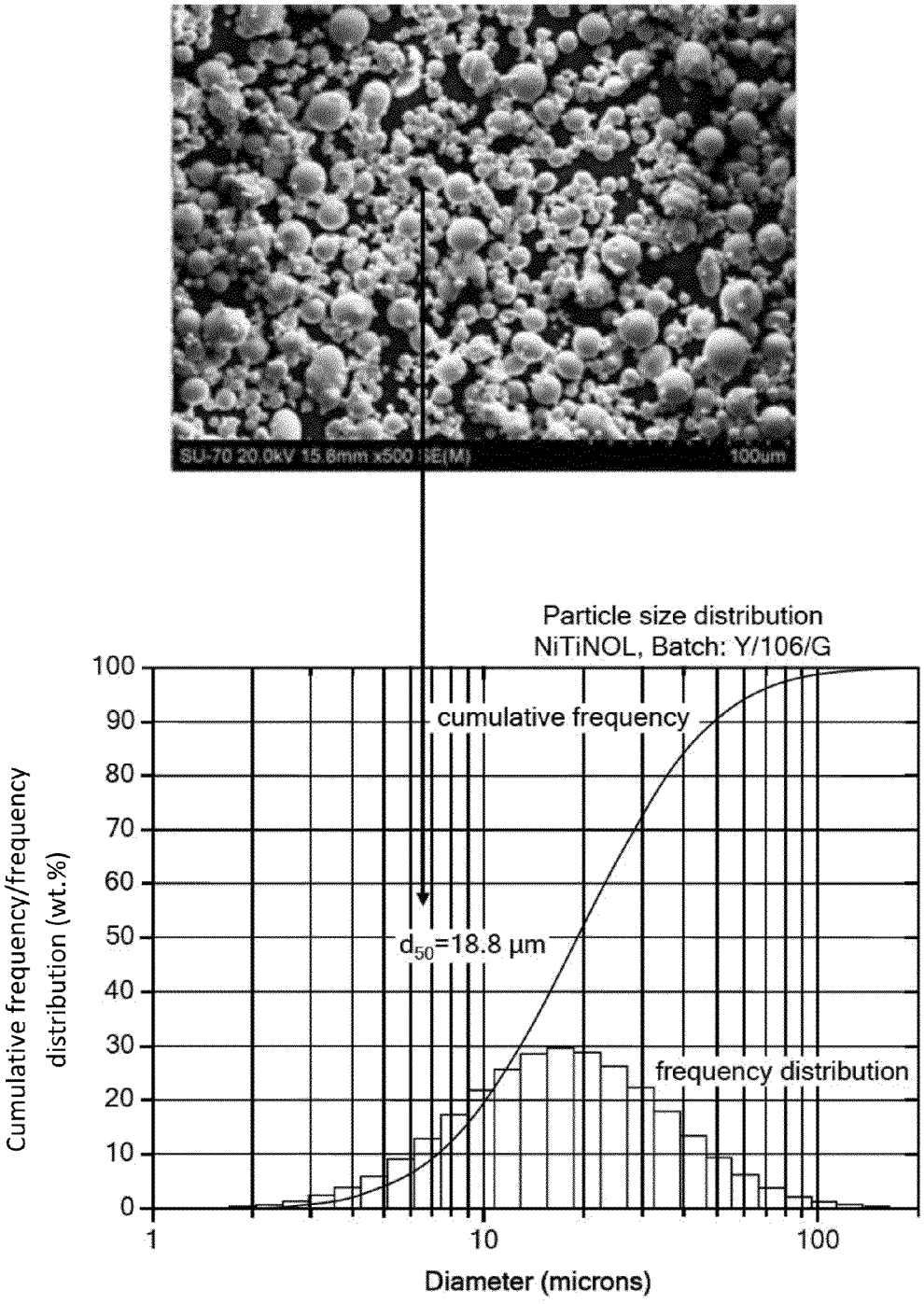
FIG. 1D is an SEM image of exemplary as-received pre-alloyed gas atomized powders having a particle size distribution as shown, where d50 is the average particle size.
Figure 1E:
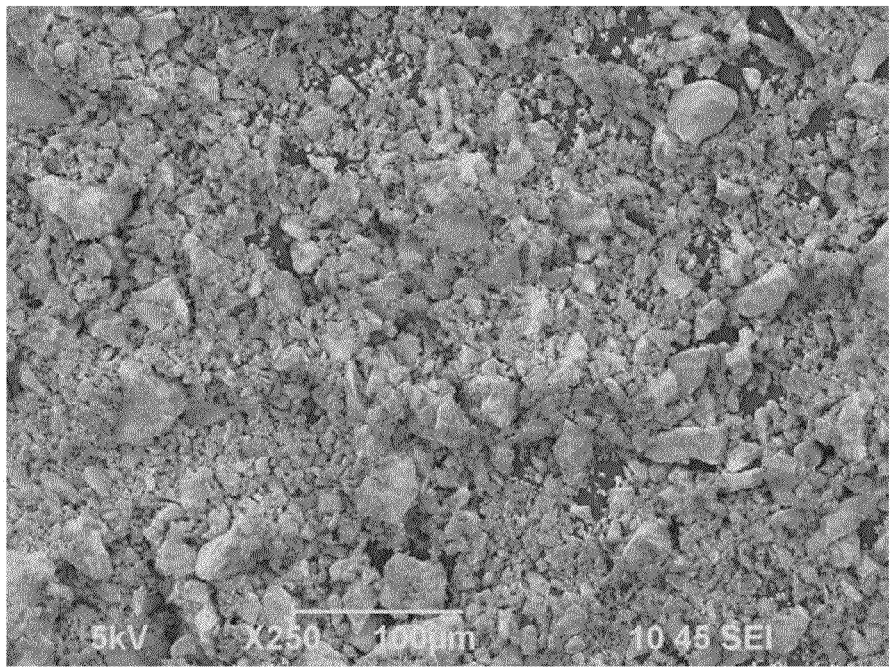
FIG. 1E is a micrograph of exemplary as-received HDH erbium powders (i.e., hydrogen embrittled Er that has been milled/shattered into powder and dehydrogenated)
Figure 1F:
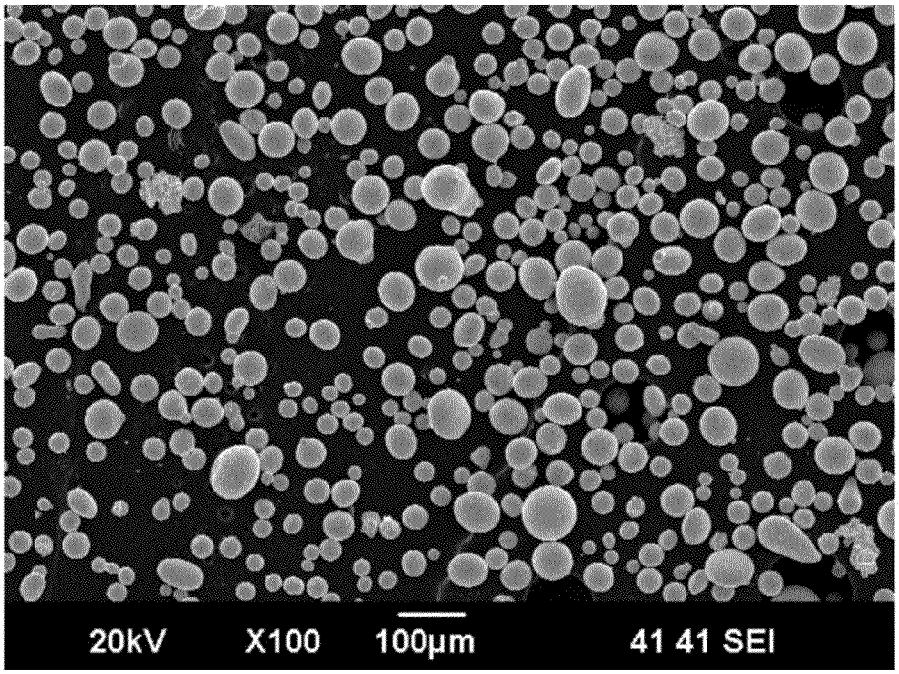
FIG. 1F is an SEM image of exemplary Er—Fe gas atomized powders before sieving.
Figure 1G:
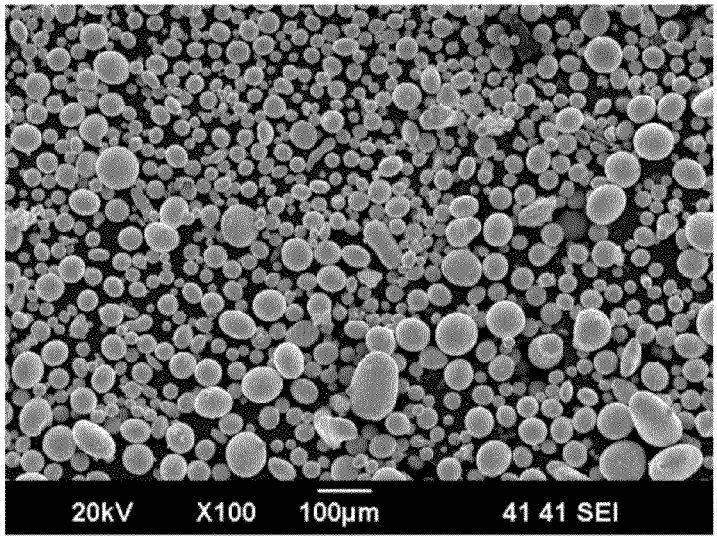
FIG. 1G is an SEM image of exemplary Er—Ag gas atomized powders before sieving.
Figure 2:
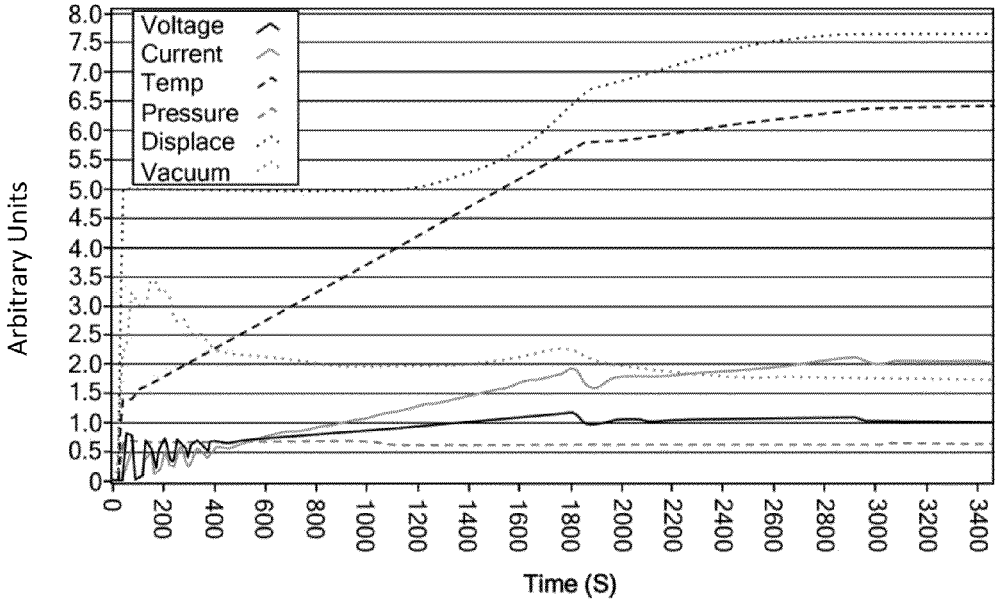
FIG. 2 shows exemplary SPS data for an optimized sintering process at a 25° C./min ramp rate and 815° C. sintering temperature, including current, temperature, voltage, pressure and displacement (compaction) time evolution curves, as recorded by an SPS machine.

Examples of suitable RE-containing powders include, for example: prealloyed RE-Ni alloy (e.g., Er—Ni alloy) powders, optionally with B or Fe doping, that may be produced by gas atomization to achieve a fine particle size (see FIGS. 1C and 1D); high purity elemental RE (e.g., Er) powders, optionally with B or Fe doping, that may be produced by gas atomization to achieve a fine particle size; lower purity elemental RE powders (e.g., hydrogenated-dehydrogenated (HDH) RE powders such as HDH Er (see FIG. 1E) that have been further dehydrogenated); and ductile rare earth alloy (or intermetallic) powders (e.g., a rare earth element alloyed with silver or another ductile metal, such as Er—Ag or Er—Fe alloy powders) (see FIGS. 1F and 1G).

Among the possible contemplated powder compositions are the following, in wt. %: Ni55:Ti45, Ni56:Ti44, Ni57:Ti43, Ni58:Ti42, Ni59:Ti41, Ni60:Ti40, Ni60.5:Ti39.5, and Ni61:Ti39; Er98.5:Fe1.5, Er(balance):Fe1.5:100 ppm B, Er(balance):100 ppm B, Er(balance):Ni25.74:Fe1, Er(balance):Ni25.74:Fe1:100 ppm B, Er(balance):Ni26:100 ppm B, assuming +/−5 wt. % Ni, +/−1 wt. % Fe or +/−0.5 wt. % Fe, and +/−50 ppm B.

The average particle size of the powders may be small, e.g., a D50 size of about 50 microns with a distribution of from about 10 microns to about 100 microns. (D50 refers to a median particle size where about 50% by weight of the particles are smaller and 50% by weight are larger than the indicated size.) The D50 size of the particles may be from about 10 to about 100 microns, or from about 30 to about 70 microns, or from about 40 to about 60 microns. However, at smaller particle sizes, the ratio of surface area to volume rises and the oxide/oxygen content may increase accordingly. Consequently, atomizing, sieving, shipping, storing, mixing and sintering is advantageously carried out in a controlled vacuum or inert gas (e.g., argon) environment if possible to minimize oxygen content.

The aforementioned powders may be obtained from commercial sources or produced using powder production methods known in the art (e.g., gas atomization, ball milling, etc.). Ni—Ti alloy powders can be atomized by most commercial gas atomization processes, including gas atomization of a super heated melt stream from a graphite crucible, cold crucible gas atomization, electrode induction-melted atomization etc. Extreme care is advisable when atomizing rare earth metals and alloys as pure rare earth metal and some high rare earth content alloys are pyrophoric when powdered. When melted at superheated temperatures, the metal is highly reactive and may attack graphite and ceramic crucibles. Pure rare earth metal and some high rare earth content alloys can be atomized via electrode induction-melted atomization and through cold crucible gas atomization. Gas atomization of a super-heated melt stream from a ceramic crucible is safe for rare earth alloys for non-reactive compositions. Extreme care is also advisable when further handling rare earth alloy powders and mixing with Ni—Ti powders. Dust clouds and increases in temperature are advantageously avoided. When mixed with Ni—Ti powders, the rare earth powders are effectively diluted and safer to handle.

The use of high purity elemental powders or RE alloy powders including a dopant element in the sintering process may be referred to as "reactive" sintering due to the proclivity of the powders to react with Ni. The scavenging of nickel from the Ni—Ti matrix by the RE element may be a downside of reactive sintering using high purity elemental RE powders, since reduced Ni levels may raise the transformation temperatures (e.g., $A_f$) of the alloy to a level at which superelasticity is not obtained at body temperature. This problem may be diminished or avoided altogether by using fully dehydrogenated HDH RE powder or by using prealloyed RE-Ni powders having a composition that compensates for the scavenging of the nickel, as set forth in the Examples below. Full dehydrogenation of HDH Er powders can be achieved by heating the powders in a furnace with at a temperature of about 900° C. under a vacuum of $10^{-10}$ bar.

Reactive sintering may be advantageous in part because the rare earth particles may reduce in size during sintering due to their reaction with the NiTi particles. This may result in either many finer particles replacing the starting rare earth particle or a halo of finer particles surrounding the now smaller initial rare earth particle. If the formation of Ti rich regions within these alloys can be eliminated and the transformation temperatures (e.g., $A_f$) controlled, this route may be very attractive in a production environment, as the ramp rate can be increased (e.g., to about 35° C./min).

A challenge with using prealloyed RE-Ni powders is that, for a given atomic percentage of the rare earth element, a larger percentage of second phase inclusions may be obtained than if an elemental rare earth powder is used; this means the superelastic matrix accounts for a smaller proportion of the alloy and the recoverable strain or the upper and lower loading plateaus may be reduced. Using a ductile and radiopaque alloy such as ErAg or other ductile rare earth intermetallic compounds, such as yttrium-silver (YAg), yttrium-copper (YCu), dysprosium-copper (DyCu), cerium-silver (CeAg), erbium-silver (ErAg), erbium-gold (ErAu), erbium-copper (ErCu), holmium-copper (HoCu), neodymium-silver (NdAg), may be a way around this (e.g., see Gschneidner Jr. K. A. et al. (2009) "Influence of the electronic structure on the ductile behaviour of B2 CsCl-type AB intermetallics," *Acta Materialia* 57, 5876-5881, which is hereby incorporated by reference), with some of the intermetallics reported to achieve >20% strain after heat treating and hot rolling.

According to one embodiment, the RE alloy powders may be RE-Fe alloy powders that include iron (Fe) in addition to the rare earth metal (RE). For example, the Fe may be present in the RE alloy powders at a concentration of from about 0.5 wt. % Fe to about 2.5 wt. % Fe, or from about 1 wt. % to about 2 wt. %, e.g., about 1.5 wt. % Fe. The balance of the RE-Fe alloy powders may be the RE element and any incidental impurities. The RE element may be selected from the group consisting of La, Ce, Pr, Nd, Pm, Sm, Eu, Gd, Tb, Dy, Ho, Er, Tm, Yb, Lu, Ac, Th, Pa, U, Y and Sc. Typically, the RE element is selected from the group consisting of La, Pr, Nd, Pm, Sm, Eu, Gd, Tb, Dy, Ho, Er, Tm, Yb, and Lu. In one example, the RE element is Er and the Er—Fe alloy powders may comprise about 1.5 wt. % Fe. In some embodiments, the RE-Fe alloy powders (which may be Er—Fe alloy powders) may further comprise B in addition to any incidental impurities. For example, the RE-Fe alloy powders may be RE-Fe-B powders including B at a concentration of from about 50 ppm to about 150 ppm.

According to another embodiment, the RE alloy powders may be RE-Ni—Fe alloy powders that include iron and nickel in addition to the rare earth metal. For example, the RE-Ni—Fe alloy powders may comprise from about 21 wt. % Ni to about 31 wt. % Ni, from about 0.5 wt. % Fe to about 1.5 wt. % Fe, and the balance (remainder) may be the rare earth element and any incidental impurities. As above, the RE element may be selected from the group consisting of La, Ce, Pr, Nd, Pm, Sm, Eu, Gd, Tb, Dy, Ho, Er, Tm, Yb, Lu, Ac, Th, Pa, U, Y and Sc. Typically, the RE element is selected from the group consisting of La, Pr, Nd, Pm, Sm, Eu, Gd, Tb, Dy, Ho, Er, Tm, Yb, and Lu. The RE-Ni—Fe alloy powders may comprise about 26 wt. % Ni and/or about 1 wt. % Fe. The RE-Ni—Fe alloy powders may further comprise B at a concentration of from about 50 ppm to about 150 ppm, e.g., about 100 ppm. In one example, the RE element may be Er and the RE-Ni—Fe alloy powders may include about 26 wt. % Ni and about 1 wt. % Fe.

According to another embodiment, the RE alloy powders may be RE-Ni—B powders that include nickel and boron in addition to the rare earth metal. For example, the RE-Ni—B alloy powders may comprise from about 21 wt. % Ni to about 31 wt. % Ni, B at a concentration of from about 50 ppm to about 150 ppm, and the balance may be the RE element and any incidental impurities. As above, the RE element may be selected from the group consisting of La, Ce, Pr, Nd, Pm, Sm, Eu, Gd, Tb, Dy, Ho, Er, Tm, Yb, Lu, Ac, Th, Pa, U, Y and Sc. Typically, the RE element is selected from the group consisting of La, Pr, Nd, Pm, Sm, Eu, Gd, Tb, Dy, Ho, Er, Tm, Yb, and Lu. In one example, the RE element may be Er and the concentration of B may be about 100 ppm. The RE-Ni—B alloy powders may comprise about 26 wt. % Ni.

According to another embodiment, the RE alloy powders may be RE-B alloy powders that include boron in addition to the rare earth metal. For example, the RE-B alloy powders may comprise B at a concentration of from about 50 ppm to about 150 ppm, and the balance may be the RE element and any incidental impurities. As above, the RE element may be selected from the group consisting of La, Ce, Pr, Nd, Pm, Sm, Eu, Gd, Tb, Dy, Ho, Er, Tm, Yb, Lu, Ac, Th, Pa, U, Y and Sc. Typically, the RE element is selected from the group consisting of La, Pr, Nd, Pm, Sm, Eu, Gd, Tb, Dy, Ho, Er, Tm, Yb, and Lu. In one example, the RE element may be Er and the concentration of B may be about 100 ppm.

A sintered Ni—Ti—RE alloy prepared from any of the above-described mixtures may include from about 5 wt. % RE to about 35 wt. % RE, from about 10 wt. % RE to about 30 wt. % RE, from about 12 wt. % RE to about 25 wt. % RE, or from about 15 wt. % RE to about 20 wt. % RE. The sintered Ni—Ti—RE alloy may also include from about 45 wt. % Ni to about 50 wt. % Ni and from about 33 wt. % Ti to about 38 wt. % Ti. The sintered Ni—Ti—RE alloy may include a NiTi matrix phase and a second phase comprising discrete regions dispersed in the matrix phase, where the second phase comprises the RE element. The second phase may also include an additional element selected from the group consisting of B, Al, Cr, Mn, Fe, Ni, Co, Cu, Zn, Ga, Ge, Zr, Nb, Mo, Tc, Ru, Rh, Pd, Ag, Cd, In, Sn, Sb, Hf, Ta, W, Re, Os, Ir, Pt, Au, Hg, Tl, Pb, Bi, Po, V, other rare earth elements, and Y. There may be more than one second phase in the sintered Ni—Ti—RE alloy. The NiTi matrix phase may comprise a Ni:Ti weight ratio of at least about 55:45, or at least about 56:44. The Ni:Ti weight ratio is typically no greater than 60:40, and may be no greater than 58:42.

The sintered Ni—Ti—RE alloy has a phase structure that depends on the composition and processing history of the alloy. The RE element, which is present in the second phase, may also be in solid solution with the NiTi matrix phase containing Ni and Ti. The second phase comprising the RE element may include Ni and/or Ti. For example, the RE element may form an intermetallic compound phase with Ni and/or with Ti. In other words, the RE element may combine with Ni in specific proportions and/or with Ti in specific proportions to form the compound phase. The RE element may substitute for Ti and form one or more intermetallic compound phases with Ni, such as, for example, NiRE, $Ni_2RE$, $Ni_3RE_2$, $Ni_3RE_7$ or another phase, e.g., $Ni_xRE_y$, where x and y may have integer values or fractional values typically from 1 to 20. Alternatively, the RE element may substitute for Ni and combine with Ti to form a solid solution or a compound such as $Ti_xRE_y$. The Ni—Ti—RE alloy may also include one or more other intermetallic compound phases of Ni and Ti, such as NiTi, which may be the matrix phase, $Ni_3Ti$ and/or $NiTi_2$, depending on the composition and heat treatment. The RE element may form a ternary intermetallic compound phase with both Ni and Ti atoms, such as $Ni_xTi_yRE_z$. The RE element may also form a quaternary intermetallic compound phase, such as $Ni_xTi_yRE_zM_m$, that includes at least one additional element (represented by M) in addition to the rare earth metal. Some exemplary phases in various Ni—Ti—RE alloys are identified below in TABLE 1, where x, y, z and m may have integer or fractional values typically from 1 to 20.

The one or more additional elements that may be present in the sintered Ni—Ti—RE alloy (in addition to the RE element) may be in solid solution with the NiTi matrix phase and/or may form one or more second phases with Ni, Ti, and/or the RE element. Accordingly, the second phase may include the additional alloying element in addition to the rare earth element. The second phase may also or alternatively include nickel (Ni) and/or titanium (Ti). The discrete particles of the second phase may have an average size of from about 1 to about 500 microns, and preferably from about 1 to about 150 microns. The matrix phase may comprise NiTi.

TABLE 1

Exemplary Phases in Ni—Ti—RE Alloys

| Alloy | Exemplary Phases |
|---|---|
| Ni—Ti—Dy | DyNi, $DyNi_2$, $Dy_xTi_y$, α(Ti), α(Ni), $Ni_xTi_yDy_z$ |
| Ni—Ti—Er | ErNi, $ErNi_2$, $Er_xTi_y$, α(Ti), α(Ni), $Ni_xTi_yEr_z$ |
| Ni—Ti—Gd | GdNi, $GdNi_2$, $Gd_xTi_y$, α(Ti), α(Ni), $Ni_xTi_yGd_z$ |
| Ni—Ti—La | LaNi, $La_2Ni_3$, $La_xTi_y$, α(Ti), α(Ni), $Ni_xTi_yLa_z$ |
| Ni—Ti—Nd | NdNi, $NdNi_2$, $Nd_xTi_y$, α(Ti), α(Ni), $Ni_xTi_yNd_z$ |
| Ni—Ti—Yb | $YbNi_2$, $Yb_xTi_y$, α(Ti), α(Ni), $Ni_xTi_yYb_z$ |

The one or more additional alloying elements present in the sintered Ni—Ti—RE alloy may be selected from the group consisting of Al, Cr, Mn, Fe, Ni, Co, Cu, Zn, Ga, Ge, Zr, Nb, Mo, Tc, Ru, Rh, Pd, Ag, Cd, In, Sn, Sb, Hf, Ta, W, Re, Os, Ir, Pt, Au, Hg, TI, Pb, Bi, Po, V, other rare earth elements, and Y. The sintered Ni—Ti—RE alloy may also or alternatively include small amounts (e.g., hundreds of ppm or less) of non-metallic elemental additions, such as, for example, B, C, H, N, or O, although non-metallic elements are generally not included in the summation of alloying elements used to specify the composition of the alloy. B may be considered to be a dopant element added intentionally to the alloy to improve workability and/or ductility, and may be present in amounts of from about 10 ppm to about 300 ppm, from about 20 to about 200 ppm, or from about 50 ppm to about 150 ppm. Preferably, the amounts of C, O, and N are consistent with the American Society of Testing and Materials (ASTM) standard F2063, so as to avoid forming a high number density of and/or large-size carbide, oxide, nitride or complex carbonitride particles, which may affect the mechanical properties of the Ni—Ti—RE alloy. H is preferably controlled per ASTM standard F2063 to minimize hydrogen embrittlement of the alloy. The aforementioned ASTM standards are hereby incorporated by reference.

In one example, the sintered Ni—Ti—RE alloy may be a sintered Ni—Ti—Er alloy that includes from about 45 wt. % to about 50 wt. % Ni, from about 33 wt. % to about 38 wt. % Ti, and from about 15 wt. % Er to about 20 wt. % Er, or from about 16 wt. % Er to about 17 wt. % Er. The sintered Ni—Ti—RE alloy may further comprise an additional element, which may be Fe and/or B. For example, the Ni—Ti—Er alloy may include from about 0.1 wt. % Fe to about 0.3 wt. % Fe. The Ni—Ti—Er alloy may also or alternatively include B in an amount of about 100 ppm or less. The sintered Ni—Ti—Er alloy may include a NiTi matrix phase and a second phase comprising discrete regions dispersed in the matrix phase, where the second phase comprises Er. The second phase may further comprise Ni. For example, the second phase comprising Er and Ni may be an erbium-rich phase including at least about 50 wt. % Er. The NiTi matrix phase may comprise the intermetallic compound NiTi.

The sintering may be carried out using a spark plasma sintering (SPS) process, which entails forming a dense compacted speciman from metal and/or alloy powders by passing a pulsed electrical current though the powders while applying a pressure thereto. A low voltage, high pulsed current may generate a spark plasma at high localized temperatures throughout the compact, generating heat uniformly through the powder.

In contrast to conventional melting techniques (e.g., vacuum induction melting (VIM) or vacuum arc melting (VAR)) for Ni—Ti—RE alloy fabrication, SPS may result in fine dispersion of the rare earth element or a secondary phase within the alloy microstructure, and thus the billet or compact produced by SPS may not need to undergo a homogenization heat treatment prior to hot or cold working. Sintering also may permit a dense ternary alloy compact to be formed at a much lower temperature (e.g., <850° C.) than a typical melting process, which is typically carried out at a temperature in excess of 1350° C., and the sintering temperature can be further reduced if desired by using smaller starting particle sizes and a higher sintering pressure. Another advantage of SPS compared to conventional melting processes and other powder metallurgy methods is that the powder particles may be purified during sintering, thereby minimizing contaminants in the resulting ternary Ni—Ti—RE alloy. It is possible to obtain extremely low oxygen and acceptable carbon contents independent of the impurity level in the starting powder. For example, the oxygen content of alloys sintered via SPS may be as low as about 0.007 at. % O, whereas an oxygen content of about 0.03 at. % O is typical of VIM melted Ni—Ti alloy specimens.

To form the sintered Ni—Ti—RE alloy, Ni—Ti alloy powders and RE alloy powders are added to a powder consolidation unit which may include an electrically conductive die and a punch connectable to a power supply. The Ni—Ti alloy powders may comprise from about 55 wt. % Ni to about 61 wt. % Ni and from about 39 wt. % Ti to about 45 wt. % Ti, and the RE alloy powders comprise a RE element and may also comprise an additional element. The RE element and the additional element may be selected as set forth above.

A pulsed electrical current may be passed through the powders and they may be heated to a desired sintering temperature, which may be from about 730° C. to about 840° C. The powders may be heated to the sintering temperature at ramp rate of about 35°/min or less, and the ramp rate is preferably about 25°/min or less. Pressure is applied to the powders at the sintering temperature, and the sintering temperature is maintained for a hold time sufficient to form a sintered Ni—Ti—RE alloy having a density of at least about 95% of theoretical density.

An advantage of the sintering process compared to melt processing is that the sintered Ni—Ti—RE alloy may be formed in a fairly short time. For example, for a 10 mm-diameter billet, the hold time employed to produce the sintered alloy typically takes from about 15 min to about 25 min, depending on the material being sintered. Generally speaking, the hold time may be at least about 1 min, at least about 10 minutes, or at least about 15 minutes, e.g., from about 1 min to about 60 min, from about 10 min to about 20 min, or from about 5 min to about 15 min. Accordingly, the sintering process may have a total time duration of about 72 minutes or less, which is significantly shorter than the time required for other sintering routes, despite the low ramp rates employed here.

In general, a low sintering temperature (e.g., <850° C.) and low ramp rate (≤35° C.) can be utilized along with an appropriate sintering pressure to successfully form a sintered Ni—Ti—RE alloy of the desired density. Higher sintering pressures, for example, at least about 50 MPa, at least about 60 MPa, at least about 70 MPa, or at least about 85 MPa, may be advantageous. Typically, the sintering pressure is no higher than about 110 MPa. For example, the pressure applied at the sintering temperature may range from about 45 MPa to about 110 MPa, or from about 60 MPa to about 100 MPa.

The pressure during sintering can be increased to compensate for a reduction in sintering temperature, and/or the average particle size of the powders can be decreased. Advantageously, the sintered alloy achieves a density of at least about 98% of theoretical density as a result of the sintering process. The density may also be at least about 95% of theoretical density, or at least about 90% of theoretical density.

As discussed in U.S. patent application Ser. No. 13/656,151, entitled "Method of Forming a Sintered Nickel-Titanium-Rare Earth Alloy," which is hereby incorporated by reference in its entirety, the sintering temperature of the Ni—Ti—RE alloy may coincide with a softening temperature of the rare earth element. The softening temperature may be the temperature at which the rare earth element has a Rockwell (E) hardness of from 17 to 20, or from 16 to 21. The softening temperature may also be related to the absolute melting temperature ($T_m$) of the rare earth element. For example, the softening temperature may be from about $0.50 \cdot T_m$ to about $0.55 \cdot T_m$. Accordingly, the desired sintering temperature may be from about 650° C. to about 850° C., or from about 700° C. to about 825° C. When the rare earth element is Er, the sintering temperature is preferably from about 730° C. to about 840° C., 740° C. to about 840° C., or from about 750° C. to about 800° C.

The sintered Ni—Ti—RE alloy may be prepared in a die having a desired final shape, so that the sintered alloy may be used in the as-pressed form as a net-shape or near net-shape component. Alternatively, the sintered Ni—Ti—RE alloy may take the form of a billet or a button and may undergo further thermomechanical processing after sintering in order to obtain a desired shape for a specific application. The mechanical and/or superelastic properties of the sintered Ni—Ti—RE alloy may also be altered or improved by thermomechanical processing, which may include one or more—e.g., a series of—hot working and/or cold working steps. A series of hot or cold working steps may be at least 3, at least 5, at least 10, at least 20, or at least 40 and typically no more than 100 hot or cold working steps carried out sequentially. The hot working may entail rolling, extrusion, forging, drawing, and/or another mechanical process carried out at an elevated temperature and resulting in plastic deformation of the sintered Ni—Ti—RE alloy. The cold working may entail rolling, extrusion, forging, drawing, and/or another mechanical process carried out at room temperature to further plastically deform the alloy. Typically, hot working is performed prior to cold working. As would be known by one of ordinary skill in the art, interpass annealing steps may be carried out between cold working steps or passes, in order to reduce strain and to increase the workability of the alloy for subsequent cold working steps. What may be referred to as interpass annealing or re-heating steps may also be be carried out between the hot working steps or passes.

In one example, the sintered Ni—Ti—RE alloy may undergo up to 60 hot rolling passes to form a 5 mm-diameter rod from the as-sintered billet, which may be about 25 mm in diameter, followed by sequential cold working (e.g., rolling and/or drawing) and interpass annealing steps in order to form an even smaller-diameter rod or wire (e.g., less than about 5 mm, less than about 3 mm, or less than about 1 mm in diameter). The hot rolling and interpass annealing steps may be carried out at a temperature in the range of from about 550° C. to about 750° C., from about 600° C. to about 750° C., or from about 630° C. to about 730° C. An area reduction of at least about 3% per pass and generally from about 5% per pass to about 30% per pass may be achieved. The area reduction may also be from about 5% per pass to about 15% per pass, or from about 5% per pass to about 10% per pass. The final cold worked form, which may be a rod or wire, may be annealed at a temperature below about 550° C., for 2-10 minutes. The annealing may be done in air, in vacuum, or in a gas environment that includes one or more of air, Ar, $N_2$ or He. A gas environment including Ar and air is preferable to prevent deterioration of the alloy due to oxidation.

Thermomechanical processing equipment known in the art may be employed for the hot and/or cold working. Advantageously, the sintered and optionally thermomechanically processed Ni—Ti—RE alloy component may have an austenite finish temperature of 37° C. or less. Due to deformation caused by hot and/or cold working, the discrete regions of the second phase(s) may comprise an elongated shape. Following cold working of the Ni—Ti—RE component, an overall % reduction in cross-sectional area of at least about 30%, at least about 50%, at least about 70%, or at least about 90% may be achieved. The % reduction per pass is typically at least about 3%, at least about 5%; at least about 10%, or at least about 20%, and is typically no higher than about 30%.

The sintering method and optional thermomechanical processing described here are believed to be particularly advantageous for forming Ni—Ti—RE alloys suitable for various applications, including use in implantable medical devices. Ni—Ti—RE alloys are described in detail in U.S. Patent Application Publication 2008/0053577, "Nickel-Titanium Alloy Including a Rare Earth Element," filed on Sep. 6, 2007, and in U.S. Patent Application Publication 2011/0114230, "Nickel-Titanium Alloy and Method of Processing the Alloy," filed on Nov. 15, 2010, both of which are hereby incorporated by reference in their entirety.

The sintering method set forth herein may be carried out using a spark plasma sintering apparatus such as, for example, Dr. Sinterlab SPS 515S (Sumitomo Coal Mining Co. Ltd., Japan). The SPS die in this case is made from high grade graphite and the sintering is performed in vacuum (~$10^{-3}$ Torr). In a typical SPS run, a powder sample is packed into the high strength graphite die and placed between the upper and lower electrodes, as shown schematically in FIGS. 1A and 1B. Exemplary powder samples suitable for sintering are shown in FIGS. 1C-1G. In the SPS apparatus, a pulsed direct current is applied through the electrodes and through the sample. For example, 12 current pulses and two off-current pulses, which is known as a 12/2 sequence, may be used. The sequence of 12 on pulses followed by 2 off pulses for a total sequence period of 46.2 ms calculates to a characteristic time of a single pulse of about 3.3 ms.

Example 1

Over 75 experiments were carried out to sinter mixtures of Ni—Ti alloy powders and RE alloy powders using different starting powder compositions and various sintering parameters, followed by hot and cold working steps. The process parameters and results are summarized in Tables 2A-6B below. The sintered samples had the physical form of small disks of 25 mm in diameter and about 4 mm in thickness.

In each experiment, a mixture of first binary alloy powders ("Ni56Ti") comprising about 56 wt. % Ni and about 44 wt. % Ti and second binary alloy powders ("Ni60Ti") comprising about 60 wt. % Ni and about 40 wt. % Ti was sintered with RE alloy powders comprising Er and Fe. Different weight ratios of the first and second binary alloy powders (Ni56Ti and Ni60Ti) were employed in the experiments. In each experiment, the Er—Fe alloy powders included 1.5 wt. % Fe. The balance (remainder) of the Er—Fe alloy powders was Er and any incidental impurities.

Table 2A shows results for samples 1-15, which included a 70:30 weight ratio of Ni56Ti to Ni60Ti powders, and Table 2B shows the composition of the sintered alloy corresponding to samples 1-15; Table 3A shows results for samples 21-35, which included a 60:40 weight ratio of Ni56Ti to Ni60Ti powders, and Table 3B shows the composition of the sintered alloy corresponding to samples 21-35; Table 4A shows results for samples 41-55, which included a 50:50 weight ratio of Ni56Ti to Ni60Ti powders, and Table 4B shows the composition of the sintered alloy corresponding to samples 41-55; Table 5A shows results for samples 61-75, which included a 40:60 weight ratio of Ni56Ti to Ni60Ti powders, and Table 5B shows the composition of the sintered alloy corresponding to samples 61-75; Table 6A shows results for samples 81-95, which included a 30:70 weight ratio of Ni56Ti to Ni60Ti powders, and Table 6B shows the composition of the sintered alloy corresponding to samples 81-95.

For each set of samples, sintering and hot rolling were carried out at temperatures of 760° C., 800° C., and 840° C. using hold times of 5 min, 30 min, or 60 min. A sintering pressure of either 60 or 70 MPa was employed in each experiment. In some cases, sintering was followed by a heat treatment at a temperature of 760° C., 800° C., or 840° C., with a heat treatment hold time of 24 min or 48 min. After sintering, hot working and then cold working were carried out, and the results are evaluated on a scale from 0 (=poor) to 3 (=superb), as indicated in the tables below. The hot working entailed hot rolling at a temperature of 760° C. or hot extruding at a temperature of 760° C.-800° C. with a short soak (about 30 min) at temperature, and the cold working entailed multiple cold rolling passes (e.g., 20-60 passes), with interpass annealing treatments at about 760° C. or less, preferably. The samples were evaluated in terms of their ability to be hot and cold worked. The best thermomechanical processing results were obtained from Ni—Ti—RE alloy samples sintered and hot rolled at a temperature of about 760° C. or less and at a pressure of about 70 MPa or higher.

Figure 3:
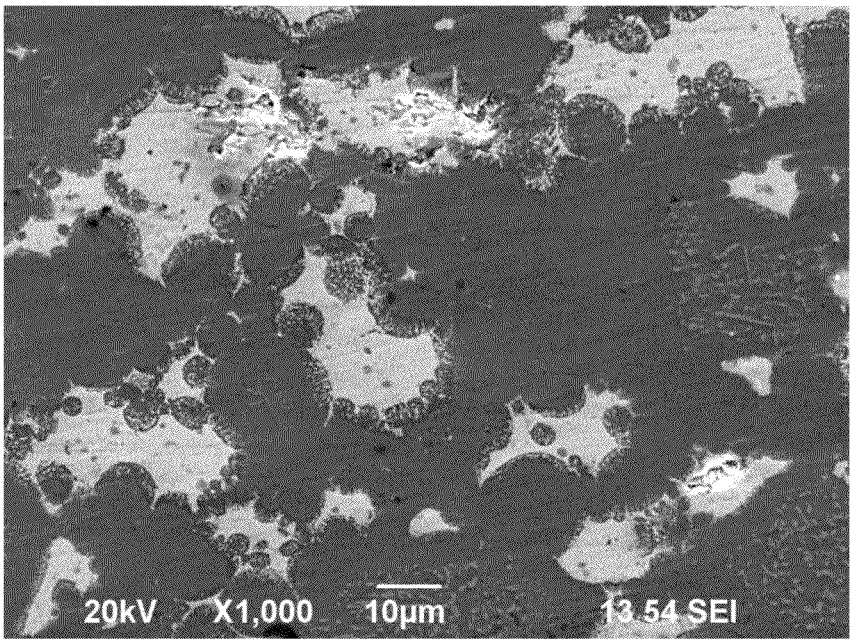
FIG. 3 is a SEM image showing the microstructure of sample no. 4 after sintering.
Figure 4:
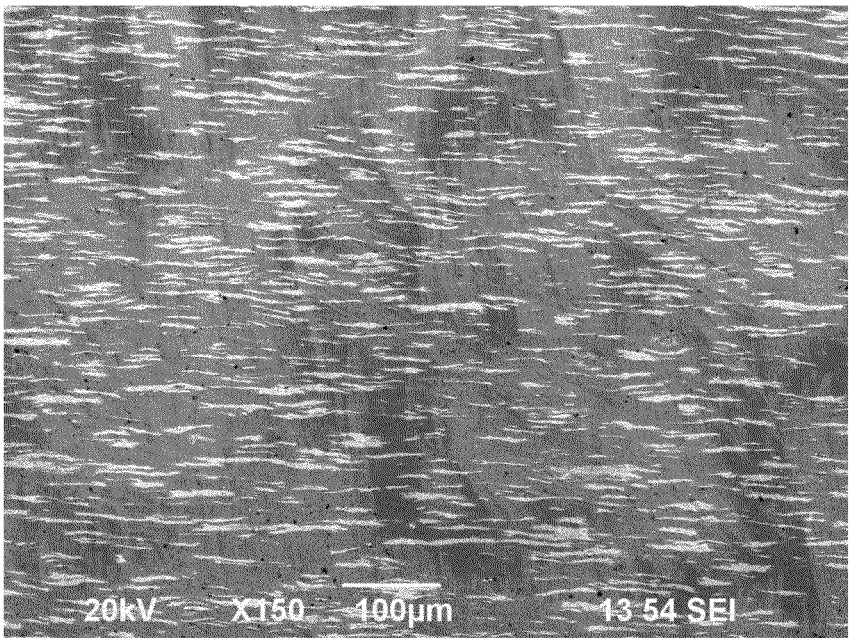
FIG. 4 is a SEM image showing the microstructure of sample no. 4 after sintering and hot rolling.
Figure 5:
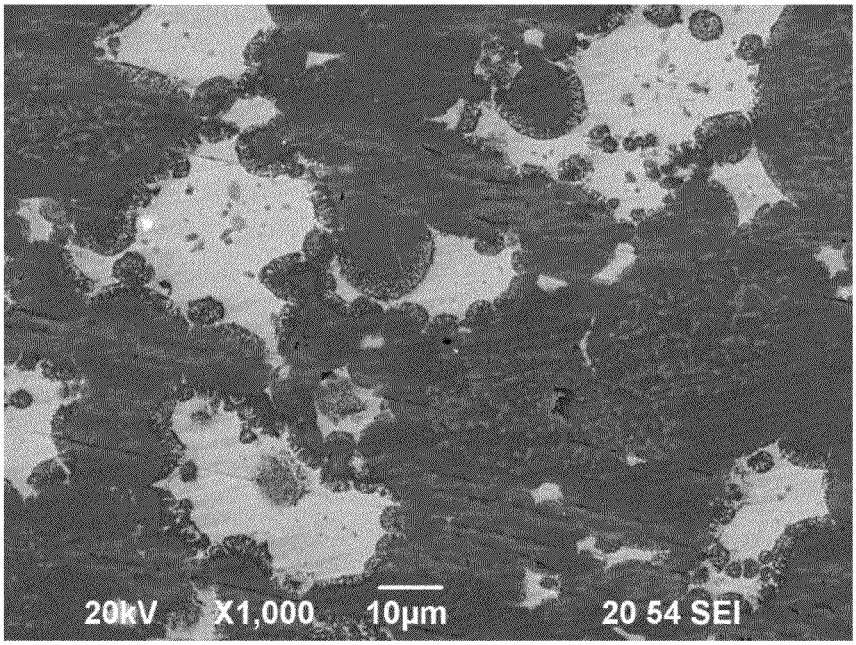
FIG. 5 is a SEM image showing the microstructure of sample no. 64 after sintering.
Figure 6:
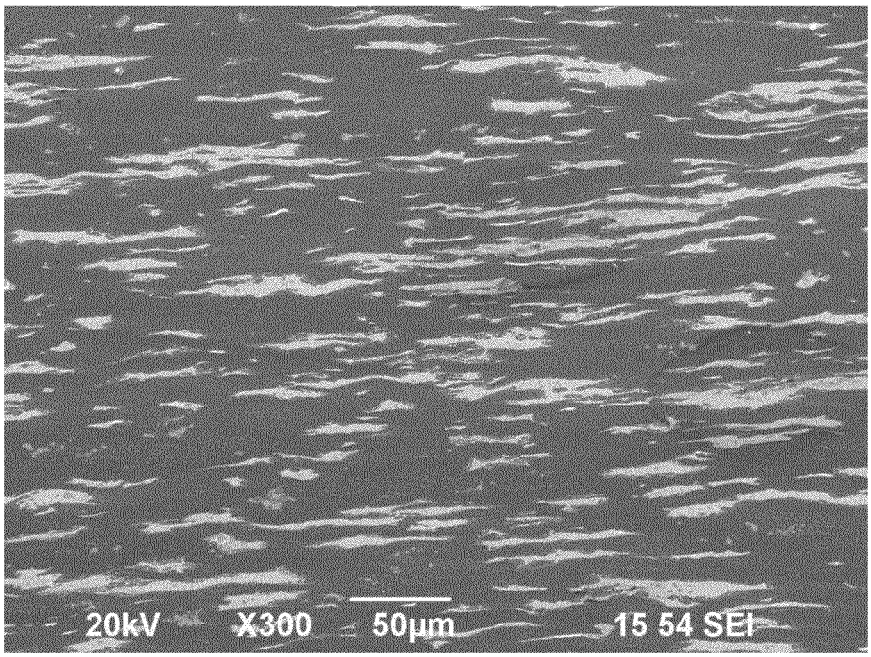
FIG. 6 is a SEM image showing the microstructure of sample no. 64 after sintering and hot rolling.

The microstructure of a number of samples in the as-sintered state and after thermomechanical processing was investigated using scanning electron microscopy (SEM). The SEM images of FIGS. 3 and 4 show sample 4 as-sintered and after hot rolling, respectively, and the SEM images of FIGS. 5 and 6 show sample 64 as-sintered and after hot rolling, respectively.

Figure 7:
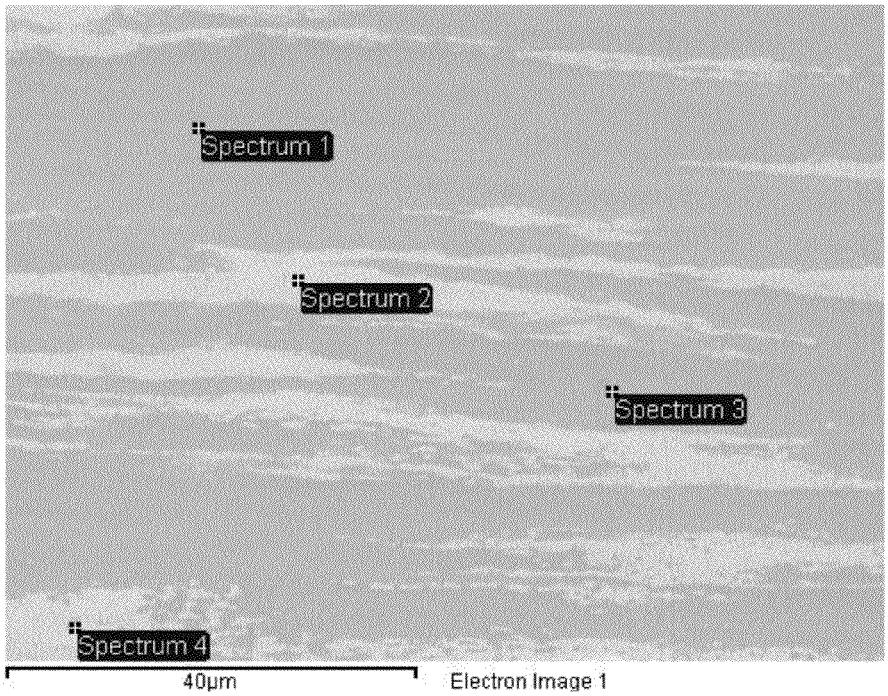
FIG. 7 is a SEM image showing the microstructure of an exemplary sintered and rolled Ni—Ti—Er—Fe sample as well as corresponding composition data obtained from energy dispersive x-ray spectroscopy analysis; the Ni—Ti—Er—Fe sample was reduced from a 25 mm-diameter sintered billet to a 5 mm-diameter rod.
Figure 8:
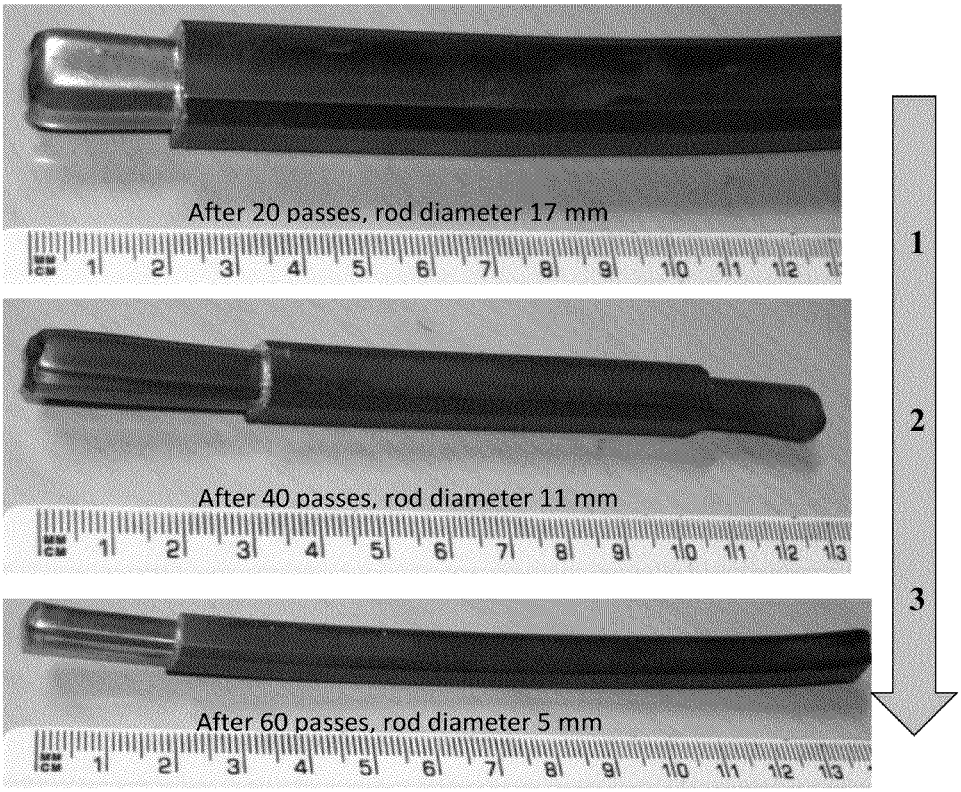
FIG. 8 shows the macroscopic appearance of an exemplary Ni—Ti—RE—Fe sintered sample after successive hot rolling passes.

Another thermomechanically processed sample is shown in the SEM image of FIG. 7 along with local composition data provided by energy dispersive x-ray spectroscopy (EDX). The initially 25 mm-diameter billet underwent hot and cold rolling into a 5 mm-diameter rod. The sintered sample was prepared from Ni56Ti powders mixed with Er—Fe alloy powders. Some cracks are evident in the ErNi second phase, but none in the NiTi matrix phase. The ErNi phase shows the formation of stringers (elongated regions) that have a strong interfacial bond with the NiTi matrix phase. Er-rich areas are observed within the ErNi phase, which are believed to improve the malleability of the phase. EDX shows that the Ni—Ti phase is Ti rich, more so in areas nearest to the Er—Ni stringers. FIG. 8 shows the macroscopic appearance of an exemplary Ni—Ti—Er—Fe sintered sample after successive hot rolling passes. (The sample was canned (contained) prior to hot rolling).

An additional set of experiments labeled N16-N20 and N36 ("N-series") is summarized in Table 7. In this series of experiments, high sintering pressures (100 MPa, with one exception of 70 MPa) were employed to enhance the workability of the Ni—Ti—RE alloys. In addition, no post-sintering heat treatments were employed, as it was found from prior experiments that the heat treatments dramatically reduced rollability due to sample grain growth, and $A_f$ was also undesirably increased. It is believed that any needed homogenization occurs during the interpass annealing steps involved in hot working and cold working without incurring significant, if any, grain growth.

The experiments carried out on the N-series of samples employed weight ratios of Ni56Ti to Ni60Ti powders of 70:30 and 60:40. Each sample was sintered at 760° C., 730° C. or 700° C. for a hold time of 30 minutes. Ramp rates to the sintering temperature were 25° C./min, 38° C./min or 50° C./min. After sintering, the N-series of samples were hot rolled (760° C.) and then cold rolled with the maximum reductions possible on the rigs. While all of the samples were successfully processed, a combination of 50:50 weight ratio and 760° C. sintering temperature was found to be best from a cold rolling point of view.

Table 8 shows the cold rolling reductions (in terms of height since the specimens were flat rolled) and interpass annealing treatments for several exemplary samples that received a score of 3 ("superb") for the hot and/or cold rolling results.

TABLE 2A

Process Conditions for Samples 1-15

| Sample No. | Ni56Ti/Ni60Ti ratio (by wt.) | Sintering and Hot Rolling Temp (° C.) | Sintering Hold Time (min) | Sintering Pressure (MPa) | Ramp rate to Sintering (° C./Min) |
|---|---|---|---|---|---|
| 1 | 70/30 | 760 | 5 | 60 | 25 |
| 2 | 70/30 | 760 | 5 | 60 | 25 |
| 3 | 70/30 | 760 | 5 | 60 | 25 |
| 4 | 70/30 | 760 | 30 | 70 | 25 |
| 5 | 70/30 | 760 | 60 | 60 | 25 |
| 6 | 70/30 | 800 | 5 | 60 | 25 |
| 7 | 70/30 | 800 | 5 | 60 | 25 |
| 8 | 70/30 | 800 | 5 | 60 | 25 |
| 9 | 70/30 | 800 | 30 | 60 | 25 |
| 10 | 70/30 | 800 | 60 | 60 | 25 |
| 11 | 70/30 | 840 | 5 | 60 | 25 |
| 12 | 70/30 | 840 | 5 | 60 | 25 |
| 13 | 70/30 | 840 | 5 | 60 | 25 |
| 14 | 70/30 | 840 | 30 | 60 | 25 |
| 15 | 70/30 | 840 | 60 | 60 | 25 |

TABLE 2A-continued

| Process Conditions for Samples 1-15 | | | | | |
|---|---|---|---|---|---|
| Sample No. | Heat Treatment Temp (C.) | Heat treatment Hold Time (min) | $A_f$ before rolling (no. of peaks, P and peak end temperature, ° C.) | Hot rolling result (0 = poor, 3 = superb) | Cold roll result (0 = poor, 3 = superb) |
| 1 | None | None | 1P end 110 C. | 1 | 1 |
| 2 | 760 | 24 | 1P end 110 C. | 1 | 0 |
| 3 | 760 | 48 | 1P end 110 C. | 1 | 0 |
| 4 | None | None | 2P end 110 C. | 3 | 3 |
| 5 | None | None | 1P end 110 C. | 0 | 0 |
| 6 | None | None | 1P end 110 C. | 1 | 1 |
| 7 | 800 | 24 | 1P end 110 C. | 0 | 0 |
| 8 | 800 | 48 | 2P end 120 C. | 0 | 0 |
| 9 | None | None | 1P end 110 C. | 3 | 1 |
| 10 | None | None | 2P end 120 C. | 2 | 1 |
| 11 | None | None | 2P end 110 C. | 1 | 1 |
| 12 | 840 | 24 | 2P end 110 C. | 0 | 0 |
| 13 | 840 | 48 | 2P end 120 C. | 0 | 0 |
| 14 | None | None | 2P end 110 C. | 3 | 0 |
| 15 | None | None | 1P end 130 C. | 3 | 0 |

TABLE 2B

| Composition of Samples 1-15 | | |
|---|---|---|
| Element | Wt. % | At. % |
| Ni | 47.78 | 49.18 |
| Ti | 35.30 | 44.53 |
| Er | 16.67 | 6.02 |
| Fe | 0.25 | 0.27 |

TABLE 3A

| Process Conditions for Samples 21-35 | | | | | |
|---|---|---|---|---|---|
| Sample No. | Ni56Ti/Ni60Ti ratio (by wt.) | Sintering and Hot Rolling Temp (° C.) | Sintering Hold Time (min) | Sintering Pressure (MPa) | Ramp rate to Sintering (° C./Min) |
| 21 | 60/40 | 760 | 5 | 60 | 25 |
| 22 | 60/40 | 760 | 5 | 60 | 25 |
| 23 | 60/40 | 760 | 5 | 60 | 25 |
| 24 | 60/40 | 760 | 30 | 70 | 25 |
| 25 | 60/40 | 760 | 60 | 60 | 25 |
| 26 | 60/40 | 800 | 5 | 60 | 25 |
| 27 | 60/40 | 800 | 5 | 60 | 25 |
| 28 | 60/40 | 800 | 5 | 60 | 25 |
| 29 | 60/40 | 800 | 30 | 60 | 25 |
| 30 | 60/40 | 800 | 60 | 60 | 25 |
| 31 | 60/40 | 840 | 5 | 60 | 25 |
| 32 | 60/40 | 840 | 5 | 60 | 25 |
| 33 | 60/40 | 840 | 5 | 60 | 25 |
| 34 | 60/40 | 840 | 30 | 60 | 25 |
| 35 | 60/40 | 840 | 60 | 60 | 25 |

| Sample No. | Heat Treatment Temp (° C.) | Heat treatment Hold Time (min) | $A_f$ before rolling (no. of peaks, P and peak end temperature, ° C.) | Hot rolling result (0 = poor, 3 = superb) | Cold roll result (0 = poor, 3 = superb) |
|---|---|---|---|---|---|
| 21 | None | None | 2P end 110 C. | 1 | 1 |
| 22 | 760 | 24 | 1P end 90 C. | 1 | 0 |
| 23 | 760 | 48 | 1P end 90 C. | 1 | 0 |
| 24 | None | None | 2P end 110 C. | 3 | 3 |
| 25 | None | None | 2P end 110 C. | 0 | 0 |
| 26 | None | None | 2P end 110 C. | 0 | 0 |
| 27 | 800 | 24 | 2P end 90 C. | 1 | 0 |
| 28 | 800 | 48 | 2P end 90 C. | 1 | 0 |
| 29 | None | None | 1P end 110 C. | 2 | 0 |
| 30 | None | None | 2P end 110 C. | 2 | 1 |
| 31 | None | None | 2P end 110 C. | 2 | 1 |
| 32 | 840 | 24 | 2P end 90 C. | 0 | 0 |

TABLE 3A-continued

| Process Conditions for Samples 21-35 | | | | | |
|---|---|---|---|---|---|
| 33 | 840 | 48 | 2P end 90 C. | 0 | 0 |
| 34 | None | None | 2P end 110 C. | 2 | 1 |
| 35 | None | None | 1P end 110 C. | 1 | 1 |

TABLE 3B

| Composition of Samples 21-35 | | |
|---|---|---|
| Element | Wt. % | At. % |
| Ni | 48.10 | 49.54 |
| Ti | 34.98 | 44.16 |
| Er | 16.67 | 6.03 |
| Fe | 0.25 | 0.27 |

TABLE 4A

| Process Conditions for Samples 41-55 | | | | | |
|---|---|---|---|---|---|
| Sample No. | Ni56Ti/Ni60Ti ratio (by wt.) | Sintering and Hot Rolling Temp (° C.) | Sintering Hold Time (min) | Sintering Pressure (MPa) | Ramp rate to Sintering (° C./Min) |
| 41 | 50/50 | 760 | 5 | 60 | 25 |
| 42 | 50/50 | 760 | 5 | 60 | 25 |
| 43 | 50/50 | 760 | 5 | 60 | 25 |
| 44 | 50/50 | 760 | 30 | 70 | 25 |
| 45 | 50/50 | 760 | 60 | 60 | 25 |
| 46 | 50/50 | 800 | 5 | 60 | 25 |
| 47 | 50/50 | 800 | 5 | 60 | 25 |
| 48 | 50/50 | 800 | 5 | 60 | 25 |
| 49 | 50/50 | 800 | 30 | 60 | 25 |
| 50 | 50/50 | 800 | 60 | 60 | 25 |
| 51 | 50/50 | 840 | 5 | 60 | 25 |
| 52 | 50/50 | 840 | 5 | 60 | 25 |
| 53 | 50/50 | 840 | 5 | 60 | 25 |
| 54 | 50/50 | 840 | 30 | 60 | 25 |
| 55 | 50/50 | 840 | 60 | 60 | 25 |

| Sample No. | Heat Treatment Temp (° C.) | Heat treatment Hold Time (min) | $A_f$ before rolling (no. of peaks, P and peak end temperature, ° C.) | Hot rolling result (0 = poor, 3 = superb) | Cold roll result (0 = poor, 3 = superb) |
|---|---|---|---|---|---|
| 41 | None | None | 2P end 110 C. | 1 | 0 |
| 42 | 760 | 24 | 1P end 70 C. | 0 | 0 |
| 43 | 760 | 48 | 1P end 70 C. | 0 | 0 |
| 44 | None | None | 2P end 110 C. | 3 | 3 |
| 45 | None | None | 2P end 110 C. | 0 | 0 |
| 46 | None | None | 2P end 110 C. | 0 | 0 |
| 47 | 800 | 24 | 2P end 50 C. | 0 | 0 |
| 48 | 800 | 48 | 2P end 50 C. | 0 | 0 |
| 49 | None | None | 1P end 110 C. | 2 | 1 |
| 50 | None | None | 2P end 110 C. | 2 | 1 |
| 51 | None | None | 2P end 110 C. | 1 | 0 |
| 52 | 840 | 24 | 2P end 30 C. | 0 | 0 |
| 53 | 840 | 48 | 2P end 30 C. | 0 | 0 |
| 54 | None | None | 2P end 110 C. | 1 | 0 |
| 55 | None | None | 1P end 110 C. | 2 | 1 |

TABLE 4B

| Composition of Samples 41-55 | | |
|---|---|---|
| Element | Wt % | At % |
| Ni | 48.41 | 49.91 |
| Ti | 34.67 | 43.79 |
| Er | 16.67 | 6.03 |
| Fe | 0.25 | 0.27 |

TABLE 5A

Process Conditions for Samples 61-75

| Sample No. | Ni56Ti/Ni60Ti ratio (by wt.) | Sintering and Hot Rolling Temp (° C.) | Sintering Hold Time (min) | Sintering Pressure (MPa) | Ramp rate to Sintering (° C./Min) |
|---|---|---|---|---|---|
| 61 | 40/60 | 760 | 5 | 60 | 25 |
| 62 | 40/60 | 760 | 5 | 60 | 25 |
| 63 | 40/60 | 760 | 5 | 60 | 25 |
| 64 | 40/60 | 760 | 30 | 70 | 25 |
| 65 | 40/60 | 760 | 60 | 60 | 25 |
| 66 | 40/60 | 800 | 5 | 60 | 25 |
| 67 | 40/60 | 800 | 5 | 60 | 25 |
| 68 | 40/60 | 800 | 5 | 60 | 25 |
| 69 | 40/60 | 800 | 30 | 60 | 25 |
| 70 | 40/60 | 800 | 60 | 60 | 25 |
| 71 | 40/60 | 840 | 5 | 60 | 25 |
| 72 | 40/60 | 840 | 5 | 60 | 25 |
| 73 | 40/60 | 840 | 5 | 60 | 25 |
| 74 | 40/60 | 840 | 30 | 60 | 25 |
| 75 | 40/60 | 840 | 60 | 60 | 25 |

| Sample No. | Heat Treatment Temp (° C.) | Heat treatment Hold Time (min) | $A_f$ before rolling (no. of peaks, P and peak end temperature, ° C.) | Hot rolling result (0 = poor, 3 = superb) | Cold roll result (0 = poor, 3 = superb) |
|---|---|---|---|---|---|
| 61 | None | None | 2P end 110 C. | 1 | 0 |
| 62 | 760 | 24 | 1P end 40 C. | 0 | 0 |
| 63 | 760 | 48 | 1P end 40 C. | 0 | 0 |
| 64 | None | None | 2P end 110 C. | 3 | 3 |
| 65 | None | None | 2P end 110 C. | 0 | 0 |
| 66 | None | None | 2P end 110 C. | 0 | 0 |
| 67 | 800 | 24 | 1P end 10 C. | 0 | 0 |
| 68 | 800 | 48 | 1P end 10 C. | 0 | 0 |
| 69 | None | None | 2P end 110 C. | 0 | 0 |
| 70 | None | None | 2P end 110 C. | 1 | 0 |
| 71 | None | None | 2P end 110 C. | 0 | 0 |
| 72 | 840 | 24 | 2P end 10 C. | 0 | 0 |
| 73 | 840 | 48 | 2P end 10 C. | 0 | 0 |
| 74 | None | None | 1P end 110 C. | 2 | 1 |
| 75 | None | None | 2P end 110 C. | 1 | 0 |

TABLE 5B

Composition of Samples 61-75

| Element | Wt % | At % |
|---|---|---|
| Ni | 48.73 | 50.26 |
| Ti | 34.35 | 43.43 |
| Er | 16.67 | 6.04 |
| Fe | 0.25 | 0.27 |

TABLE 6A

Process Conditions for Samples 81-95

| Sample No. | Ni56Ti/Ni60Ti ratio (by wt.) | Sintering and Hot Rolling Temp (° C.) | Sintering Hold Time (min) | Sintering Pressure (MPa) | Ramp rate to Sintering (° C./Min) |
|---|---|---|---|---|---|
| 81 | 30/70 | 760 | 5 | 60 | 25 |
| 82 | 30/70 | 760 | 5 | 60 | 25 |
| 83 | 30/70 | 760 | 5 | 60 | 25 |
| 84 | 30/70 | 760 | 30 | 70 | 25 |
| 85 | 30/70 | 760 | 60 | 60 | 25 |
| 86 | 30/70 | 800 | 5 | 60 | 25 |
| 87 | 30/70 | 800 | 5 | 60 | 25 |
| 88 | 30/70 | 800 | 5 | 60 | 25 |
| 89 | 30/70 | 800 | 30 | 60 | 25 |
| 90 | 30/70 | 800 | 60 | 60 | 25 |
| 91 | 30/70 | 840 | 5 | 60 | 25 |
| 92 | 30/70 | 840 | 5 | 60 | 25 |
| 93 | 30/70 | 840 | 5 | 60 | 25 |

TABLE 6A-continued

| Process Conditions for Samples 81-95 | | | | | |
|---|---|---|---|---|---|
| 94 | 30/70 | 840 | 30 | 60 | 25 |
| 95 | 30/70 | 840 | 60 | 60 | 25 |

| Sample No. | Heat Treatment Temp (° C.) | Heat treatment Hold Time (min) | $A_f$ before rolling (no. of peaks, P and peak end temperature, ° C.) | Hot rolling result (0 = poor, 3 = superb) | Cold roll result (0 = poor, 3 = superb) |
|---|---|---|---|---|---|
| 81 | None | None | 2P end 110 C. | 0 | 0 |
| 82 | 760 | 24 | 2P end 10 C. | 0 | 0 |
| 83 | 760 | 48 | 2P end 10 C. | 0 | 0 |
| 84 | None | None | 2P end 110 C. | 2 | 2 |
| 85 | None | None | 2P end 110 C. | 0 | 0 |
| 86 | None | None | 2P end 110 C. | 0 | 0 |
| 87 | 800 | 24 | 1P end 20 C. | 0 | 0 |
| 88 | 800 | 48 | 1P end 20 C. | 0 | 0 |
| 89 | None | None | 1P end 110 C. | 1 | 0 |
| 90 | None | None | 1P end 110 C. | 2 | 0 |
| 91 | None | None | 2P end 110 C. | 1 | 0 |
| 92 | 840 | 24 | 2P end 30 C. | 0 | 0 |
| 93 | 840 | 48 | 2P end 30 C. | 0 | 0 |
| 94 | None | None | 2P end 110 C. | 1 | 0 |
| 95 | None | None | 1P end 110 C. | 2 | 0 |

TABLE 6B

| Composition of Samples 81-95 | | |
|---|---|---|
| Element | Wt. % | At. % |
| Ni | 49.05 | 50.64 |
| Ti | 34.03 | 43.05 |
| Er | 16.67 | 6.04 |
| Fe | 0.25 | 0.27 |

TABLE 7

| Process Conditions for Samples N16-N20 and N36 | | | | | |
|---|---|---|---|---|---|
| Sample No. | Ni56Ti/Ni60Ti ratio (by wt.) | Sintering and Hot Rolling Temp (° C.) | Sintering Hold Time (min) | Sintering Pressure (MPa) | Ramp rate to Sintering (° C./Min) |
| N16 | 70/30 | 760 | 30 | 70 | 25 |
| N17 | 70/30 | 760 | 30 | 100 | 25 |
| N18 | 70/30 | 730 | 30 | 100 | 25 |
| N19 | 70/30 | 700 | 30 | 100 | 25 |
| N20 | 70/30 | 760 | 30 | 100 | 38 |
| N36 | 60/40 | 760 | 30 | 100 | 50 |

| Sample No. | Heat Treatment Temp (C.) | Heat treatment Hold Time (min) | $A_f$ before rolling (no. of peaks, P and peak end temperature, ° C.) | Hot rolling result (0 = poor, 3 = superb) | Cold roll result (0 = poor, 3 = superb) |
|---|---|---|---|---|---|
| N16 | None | None | 1P end 110 C. | 3 | 3 |
| N17 | None | None | 1P end 110 C. | 3 | 3 |
| N18 | None | None | 1P end 110 C. | 3 | 2 |
| N19 | None | None | 2P end 110 C. | 0 | 0 |
| N20 | None | None | 1P end 110 C. | 3 | 3 |
| N36 | None | None | 1P end 110 C. | 3 | 2 |

TABLE 8

| Cold Working of Exemplary Samples | | | | | | | |
|---|---|---|---|---|---|---|---|
| Sample | N16 | N17 | N18 | N20 | N36 | 24 | 64 |
| % reduction | 11 | 17.6 | 14.6 | 16 | 18.1 | 20 | 10 |
| Interpass anneal | 730° C. for 5 min | | | | | | |
| % reduction | 20 | 9.5 | 14.3 | 10.5 | 14.6 | 20 | 12 |
| Interpass anneal | 730° C. for 5 min | | | 730° C. for 5 min | | | 730° C. for 5 min |
| % reduction | 6 | 13.2 | Crack | 11.8 | Break | Crack | 6 |
| Anneal | 550° C. for 3 min | | | | | | |

Example 2

Additional sintering and thermomechanical processing experiments were carried out on an second set of powder mixtures comprising Ni—Ti alloy and RE alloy powders. As in the above-described experiments, the RE alloy powders were Er—Fe alloy powders including about 1.5 wt. % Fe, with the balance being Er and any incidental impurities. In several experiments (Samples S1-S10), Ni—Er alloy powders were used instead of the Er—Fe alloy powders. Cylindrical billets or ingots of about 30-35 mm in length and 25 mm in diameter were formed in the sintering experiments (in contrast to the disks formed in Example 1).

In some of the experiments, a mixture of first binary alloy powders ("Ni56Ti") comprising about 56 wt. % Ni and about 44 wt. % Ti and second binary alloy powders ("Ni60Ti") comprising about 60 wt. % Ni and about 40 wt. % Ti was sintered with Er—Fe or Ni—Er alloy powders. Different weight ratios of the first and second binary alloy powders (Ni56Ti and Ni60Ti) were used in the mixtures. In other experiments, only Ni56Ti powders or Ni60Ti powders were sintered with the Er—Fe alloy powders. In the case of samples S18-S20 (see Table 9 below) the particle sizes of the powders were as follows: for the Ni56Ti powders, the d50 size was 18.8 μm; for the Ni60Ti powders, the d50 size was 25-50 μm; and for the Er—Fe alloy powders, the d50 particle size was 25-50 μm. The sintering was carried out at a temperature ranging from about 760° C. to about 880° C. and at a pressure of about 50 MPa to about 85 MPa, as summarized in Table 9 below. All ramp rates were about 25° C./min or less. No homogenization heat treatments were carried out.

As in the experiments of Example 1, 760° C. was found to be a preferred sintering temperature to produce a sintered Ni—Ti—RE alloy with a good capacity to be hot and cold worked. Also, a sintering pressure of at least about 85 MPa and a sintering time of about 15 min or less have been identified as preferred process conditions.

TABLE 9

| Process Conditions for Samples S1-S20 | | | | |
|---|---|---|---|---|
| Sample No. | Powder Composition | Amount of Er in Sintered Sample (at. %) | Sintering Temperature (° C.) | Sintering Time (min) |
| S1 | 2/3Ni56Ti + 1/3Ni60Ti + NiEr | 6 | 780 | 10 |
| S2 | Ni56Ti + NiEr | 6 | 780 | 10 |
| S3 | Ni56Ti + NiEr | 6 | 780 | 10 |
| S4 (S3+) | Ni56Ti + NiEr | 6 | S3+ 820 | 10 |
| S5 (S2+) | Ni56Ti + NiEr | 6 | S2+ 850 | 10 |
| S6 | Ni56Ti + NiEr | 6 | 850 | 10 |
| S7 | Ni56Ti + NiEr | 6 | 880 | 15 |
| S8 | Ni56Ti + NiEr | 6 | 880 | 15 |
| S9 | Ni56Ti + NiEr | 6 | 880 | 15 |
| S10 | Ni56Ti + NiEr | 6 | 800 | 15 |
| S11 | Ni56Ti + ErFe | 6 | 780 | 15 |
| S12 | (2.5/3)Ni56Ti + (0.5/3)Ni60Ti + ErFe | 6 | 780 | 15 |
| S13 | (2.75/3)Ni56Ti + (0.25/3)Ni60Ti + ErFe | 6 | 780 | 15 |
| S14 | (2.5/3)Ni56Ti + (0.5/3)Ni60Ti + ErFe | 6 | 780 | 15 |
| S15 | (2.5/3)Ni56Ti + (0.5/3)Ni60Ti + ErFe | 6 | 780 | 15 |
| S16 | Ni60Ti + ErFe | 7.5 | 780 | 15 |
| S17 | Ni60Ti + ErFe | 9 | 780 | 15 |
| S18 | Ni60Ti + ErFe | 6 | 760 | 15 |
| S19 | Ni56Ti + Ni60Ti (50:50 ratio) + ErFe | 6 | 760 | 15 |
| S20 | Ni56Ti + Ni60Ti (50:50 ratio) + ErFe | 6 | 760 | 15 |

| Sample No. | Sintering Pressure (MPa) | Hot Roll Temperature | Hot Roll Result (0 = poor, 3 = superb) | Cold Draw Result (0 = poor, 3 = superb) |
|---|---|---|---|---|
| S1 | 50 | 780° C. | 0 | 0 |
| S2 | 50 | 820° C. | 1 | 0 |
| S3 | 50 | 850° C. | 2 | 0 |
| S4 (S3+) | 50 | 820° C. | 1 | 0 |
| S5 (S2+) | 50 | 850° C. | 1 | 0 |
| S6 | 50 | 850° C. | 2 | 0 |
| S7 | 50 | 800° C. | 0 | 0 |
| S8 | 50 | 820° C. | 0 | 0 |
| S9 | 50 | 850° C. | 0 | 0 |
| S10 | 50 | 800° C. | 1 | 0 |
| S11 | 70 | 780° C. | 2 | Not attempted |
| S12 | 70 | 780° C. | 2 | Not attempted |
| S13 | 70 | 780° C. | 2 | Not attempted |
| S14 | 70 | 780° C. | 2 | Not attempted |
| S15 | 70 | 780° C. | 2 | Not attempted |
| S16 | 70 | 780° C. | 0 | 0 |
| S17 | 70 | 780° C. | 0 | 0 |
| S18 | 85 | 760° C. | 0 | 0 |
| S19 | 85 | 760° C. | 3 | 3 |
| S20 | 100 | 760° C. | 3 | 3 |

After sintering, the sintered samples, which may be referred to as ingots or billets, were hot and cold worked. The hot working entailed canning (containing) and then hot rolling the ingots down to a diameter of about 3 mm. A square rolling rig was used for the hot rolling. First, the sintered ingots were hot rolled down to an 8 mm rod using all 12 grooves. The hot rolled samples were then decanned and recanned with thicker cans and then passed through 11 of the grooves. Interpass annealing or re-heating was carried out at 760° C. for 3 mins before each single pass. The samples were successfully hot rolled down to 3 mm-diameter rods.

Figure 9:
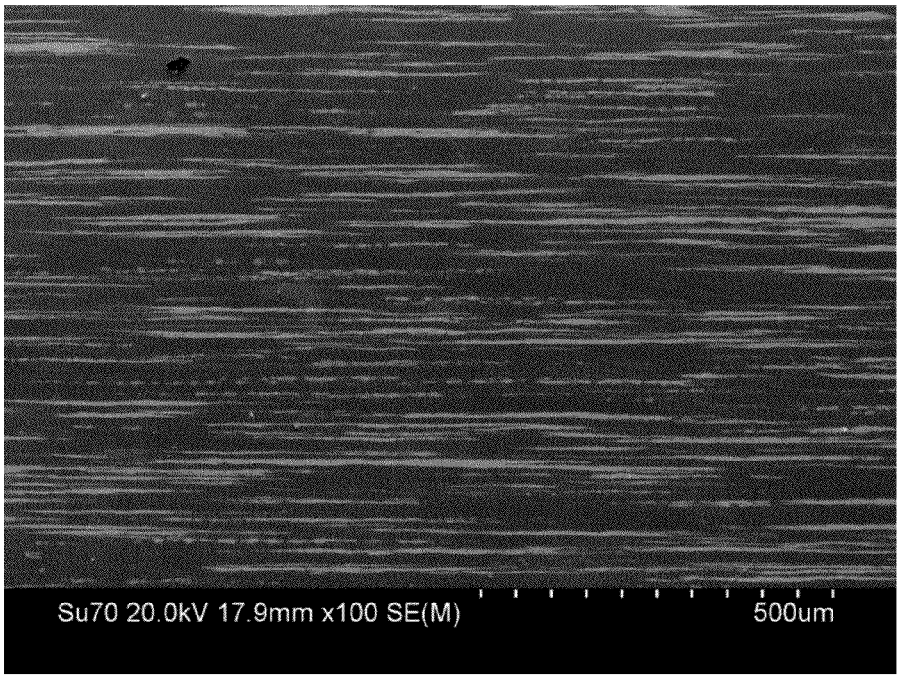
FIG. 9 is a SEM image showing the microstructure of an exemplary hot rolled sample.

FIG. 9 is a SEM image of the microstructure of an exemplary hot rolled sample. As can be observed, the maximum width of the NiEr stringer is about ~20 μm. A transverse lighter contrast may be observed in some of the smaller-width stringers.

The hot rolled ingots were cold drawn to diameters of 2 mm or less and in some cases less than 1 m (e.g., about 0.8 mm). A 3 mm to 0.5 mm die with a 10% area reduction in each pass was employed for the cold drawing. Interpass annealing steps were carried out between cold drawing steps at a temperature of about 760° C. for 3 min before each single pass. The interpass annealing steps were done in air.

Figure 10A:
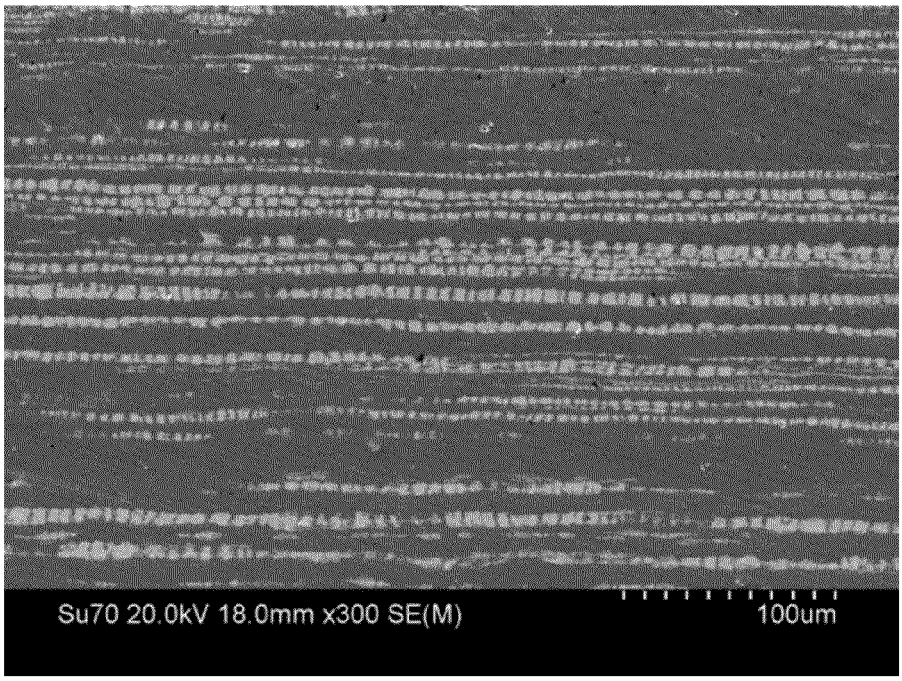
FIGS. 10A-10C are SEM images of the microstructure of cold drawn wire samples having a diameter of 2 mm (FIG. 10A), 1.71 mm (FIG. 10B), and 0.8 mm (FIG. 10C)
Figure 10B:
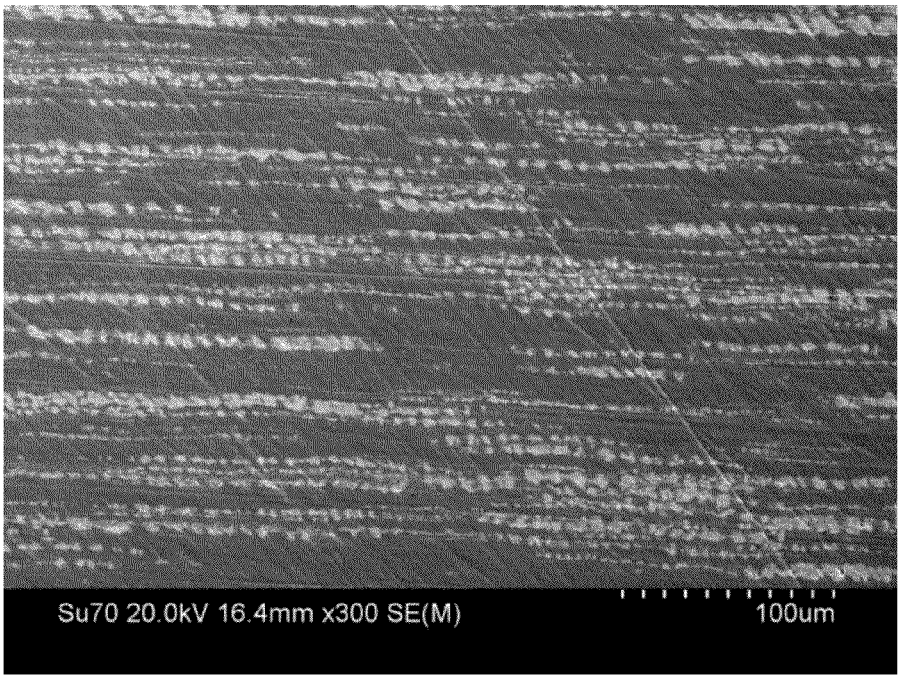
Figure 10C:
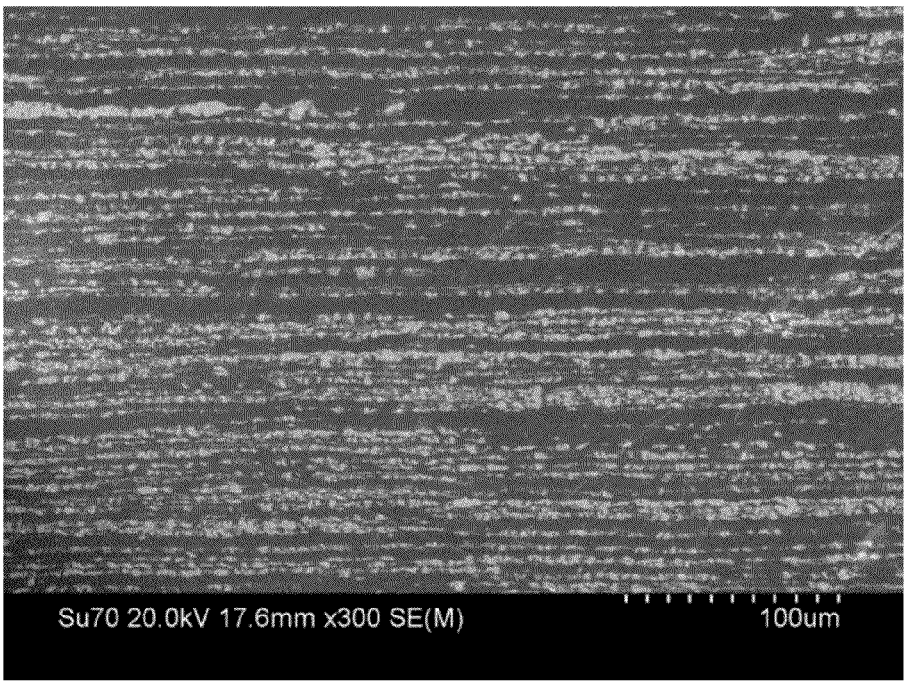

FIGS. 10A-10C are SEM images of the microstructure of cold drawn wire samples having a diameter of 2 mm (FIG. 10A), 1.71 mm (FIG. 10B), and 0.8 mm (FIG. 10C). The micrographs show that the maximum width of NiEr stringers is reduced with increased drawing passes (and reduced wire diameter). The stringers are ~1-5 μm in width in the 0.8 mm-diameter wire. The stringers exhibit transverse breaks along their length, creating the appearance of a railroad track.

Figure 11:
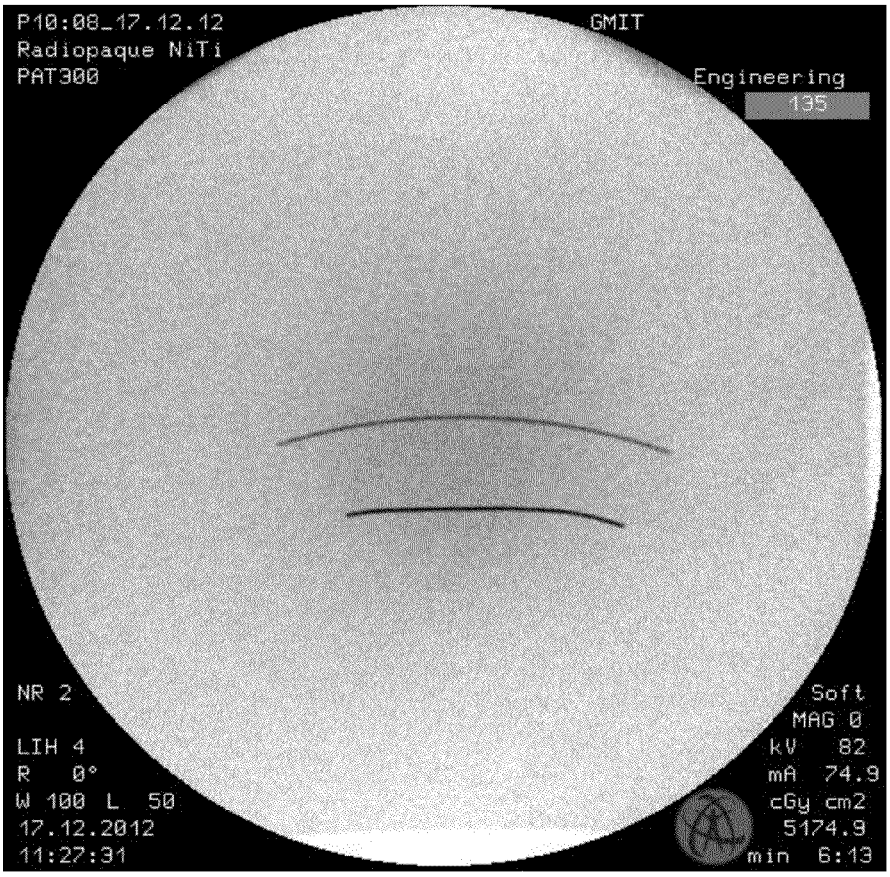
FIG. 11 is an x-ray image of a binary Ni—Ti alloy wire (top) compared to a Ni—Ti—RE alloy wire (bottom).

After cold drawing, the $A_f$ of the drawn wire is in the range of from about 40° C. to about 50° C., as measured for the 1.71 mm diameter cold drawn wire and the 0.8 mm diameter cold drawn wire after annealing for 3 min at 500° C. Bend and free recovery tests were performed on the cold drawn 1.71 mm diameter wire and the 1.46 mm diameter wire. As shown in the x-ray image of FIG. 11, the Ni—Ti—Er—Fe wire (bottom) exhibits increased radiopacity as compared to a binary Ni—Ti alloy wire (top).

Although the present invention has been described in considerable detail with reference to certain embodiments thereof, other embodiments are possible without departing from the present invention. The spirit and scope of the appended claims should not be limited, therefore, to the description of the preferred embodiments contained herein. All embodiments that come within the meaning of the claims, either literally or by equivalence, are intended to be embraced therein. Furthermore, the advantages described above are not necessarily the only advantages of the invention, and it is not necessarily expected that all of the described advantages will be achieved with every embodiment of the invention.

It is to be understood that the different features of the various embodiments described herein can be combined together. It is also to be understood that although the dependent claims are set out in single dependent form the features of the claims can be combined as if the claims were in multiple dependent form.

The invention claimed is:

1. A mixture of powders for preparing a sintered nickel-titanium-rare earth (Ni—Ti—RE) alloy, the mixture comprising:

Ni—Ti alloy powders comprising from about 55 wt. % Ni to about 61 wt. % Ni and from about 39 wt. % Ti to about 45 wt. % Ti and comprising a mixture of first and second binary alloy powders of different weight percentages of Ni and Ti; and RE alloy powders comprising a RE element.

2. The mixture of claim 1, wherein the first binary alloy powders comprise about 56 wt. % Ni and about 44 wt. % Ti and the second binary alloy powders comprise about 60 wt. % Ni and about 40 wt. % Ti.

3. The mixture of claim 1, wherein a weight ratio of the first binary alloy powders to the second binary alloy powders is from about 70:30 to about 30:70.

4. The mixture of claim 3, wherein a weight ratio of the first binary alloy powders to the second binary alloy powders is about 40:60 to about 50:50.

5. The mixture of claim 1, wherein the RE alloy powders comprise at least one additional element.

6. The mixture of claim 5, wherein the at least one additional element is a dopant element or an additional alloying element selected from the group consisting of: B, Al, Cr, Mn, Fe, Ni, Co, Cu, Zn, Ga, Ge, Zr, Nb, Mo, Tc, Ru, Rh, Pd, Ag, Cd, In, Sn, Sb, Hf, Ta, W, Re, Os, Ir, Pt, Au, Hg, Tl, Pb, Bi, Po, V, other rare earth elements, and Y.

7. The mixture of claim 6, wherein the at least one additional element includes Fe.

8. The mixture of claim 7, wherein the Fe is present in the RE alloy powders at a concentration of from about 1 wt. % to about 2 wt. %.

9. The mixture of claim 1, wherein the RE element is selected from the group consisting of La, Pr, Nd, Pm, Sm, Eu, Gd, Tb, Dy, Ho, Er, Tm, Yb, and Lu.

10. The mixture of claim 1, wherein the first binary alloy powders comprise about 56 wt. % Ni and about 44 wt. % Ti and the second binary alloy powders comprise about 60 wt. % Ni and about 40 wt. % Ti, wherein a weight ratio of the first binary alloy powders to the second binary alloy powders is from about 40:60 to about 50:50, wherein the RE element is Er and the RE alloy powders comprise Fe at a concentration of from about 1 wt. % to about 2 wt. %.

11. A sintered Ni—Ti—RE alloy prepared from the mixture of claim 1, the sintered Ni—Ti—RE alloy including from about 45 wt. % to about 50 wt. % Ni, from about 33 wt. % to about 38 wt. % Ti, and from about 15 wt. % RE to about 20 wt. % RE.

12. The sintered Ni—Ti—RE alloy of claim 11, wherein the RE element includes Er.

13. The sintered Ni—Ti—RE alloy of claim 12 further including Fe.

14. The sintered Ni—Ti—RE alloy of claim 11 including a NiTi matrix phase and a second phase including discrete regions dispersed in the matrix phase, the second phase including the RE element.

15. A thermomechanically processed component prepared from the sintered Ni—Ti—RE alloy of claim 11 comprising an austenite finish temperature of less than 37° C.

16. A method of forming a sintered nickel-titanium-rare earth (Ni—Ti—RE) alloy, the method including:

adding Ni—Ti alloy powders and RE alloy powders to a powder consolidation unit including an electrically conductive die and punch connectable to a power supply, the Ni—Ti alloy powders including from about 55 wt. % Ni to about 61 wt. % Ni and from about 39 wt. % Ti to about 45 wt. % Ti and comprising a mixture of first and second binary alloy powders of different weight percentages of Ni and Ti, the RE alloy powders including a RE element;

heating the powders to a sintering temperature of from about 730° C. to about 840° C.;

applying a pressure of from about 60 MPa to about 100 MPa to the powders at the sintering temperature; and forming a sintered Ni—Ti—RE alloy.

17. The method of claim 16, wherein a ramp rate to the sintering temperature is about 25° C./min or less.

18. The method of claim 16, wherein RE element includes Er, wherein the pressure is at least about 85 MPa, and wherein the sintering temperature is from about 730° C. to about 760° C.

19. The method of claim 16, wherein the sintered Ni—Ti—RE alloy further includes Fe.

20. The method of claim 16, further including hot working the sintered Ni—Ti—RE alloy at a temperature of at least about 730° C. to form a hot worked Ni—Ti—RE alloy component, and further including cold drawing the hot worked Ni—Ti—RE alloy component to form a Ni—Ti—RE alloy wire having a diameter of about 2 mm or less.

21. The mixture of claim 1, wherein the first binary alloy powders include about 54-58 wt. % Ni and about 42-46 wt. % Ti and the second binary alloy powders include about 58-62 wt. % Ni and about 38-42 wt. % Ti.

22. The mixture of claim 1, wherein a ratio of the Ni—Ti alloy powders to the RE alloy powders is at least about 60:40 and no more than about 90:10.

23. The method of claim 16, wherein the first binary alloy powders include about 54-58 wt. % Ni and about 42-46 wt. % Ti and the second binary alloy powders include about 58-62 wt. % Ni and about 38-42 wt. % Ti.

24. The method of claim 16, wherein the first binary alloy powders include about 56 wt. % Ni and about 44 wt. % Ti and the second binary alloy powders include about 60 wt. % Ni and about 40 wt. % Ti.

25. The method of claim 16, wherein a weight ratio of the first binary alloy powders to the second binary alloy powders is from about 70:30 to about 30:70.

26. The method of claim 16, wherein a ratio of the Ni—Ti alloy powders to the RE alloy powders is at least about 60:40 and no more than about 90:10.

* * * * *